US012460542B2

(12) United States Patent
Sperle et al.

(10) Patent No.: US 12,460,542 B2
(45) **Date of Patent: *Nov. 4, 2025**

(54) METHOD AND APPARATUS FOR QUANTITATIVE MULTI-PHASE DOWNHOLE SURVEILLANCE

(71) Applicant: RESMAN AS, Ranheim (NO)

(72) Inventors: Thomas Sperle, Ranheim (NO); Øystein Mølstre, Ranheim (NO)

(73) Assignee: Resman AS, Ranheim (NO)

( * ) Notice: Subject to any disclaimer, the term of this patent is extended or adjusted under 35 U.S.C. 154(b) by 0 days.

This patent is subject to a terminal disclaimer.

(21) Appl. No.: 18/664,359

(22) Filed: May 15, 2024

(65) Prior Publication Data

US 2024/0328306 A1 Oct. 3, 2024

Related U.S. Application Data

(63) Continuation of application No. 17/613,733, filed as application No. PCT/EP2020/064348 on May 23, 2020, now Pat. No. 12,012,848.

(30) Foreign Application Priority Data

May 24, 2019 (GB) ..... 1907388

(51) Int. Cl.
*E21B 47/11* (2012.01)
*E21B 43/38* (2006.01)
*E21B 49/08* (2006.01)

(52) U.S. Cl.
CPC ..... *E21B 47/11* (2020.05); *E21B 43/38* (2013.01); *E21B 49/08* (2013.01)

(58) Field of Classification Search
CPC ..... E21B 47/11; E21B 49/08; E21B 49/088; E21B 49/0875; E21B 43/38; B01D 2221/04; B01D 17/02
See application file for complete search history.

(56) References Cited

U.S. PATENT DOCUMENTS 8,215,388 B2 7/2012 Van Zuilekom et al.
8,596,354 B2 12/2013 Hartshome et al.
(Continued)

FOREIGN PATENT DOCUMENTS

EP 1416118 A1 5/2004
WO WO 2015030596 A1 3/2015
WO WO2016137328 A1 9/2016

OTHER PUBLICATIONS

International Search Report and Written Opinion dated Dec. 7, 2020 for PCT/EP2020/064348.

*Primary Examiner* — Kenneth L Thompson
(74) *Attorney, Agent, or Firm* — FisherBroyles, LLP

(57) ABSTRACT

The invention provides a method for quantitative downhole surveillance of a multi-phase flow, comprising at least two phases of either oil, water or gas, in a petroleum well. The method comprising providing at least one shunt chamber which comprises a flow phase separation section, a delay chamber, one or more outlet ports, at least one flow restrictor and a tracer release system with one or more tracers. The method comprises separating a shunt flow in the shunt chamber into a low-density flow phase and a high-density flow phase; releasing at least one tracer into the tracer delay chamber. The method also comprises passing the separated low-density flow phase and high-density flow phase through each flow restrictor and flushing out the low-density phase flow and the high-density phase flow with tracer from the shunt chamber through the outlet ports into the local flow inside the well. The method comprises monitoring the at least one tracer in the production flow at a detection point downstream of the outlet ports and measuring

20 Claims, 20 Drawing Sheets

(56) References Cited

U.S. PATENT DOCUMENTS

| | | | | |
|---|---|---|---|---|
| 9,046,399 | B2 | 6/2015 | Gysling | |
| 9,777,555 | B2 | 10/2017 | Donzier | |
| 9,896,913 | B2 | 2/2018 | Nyhavn et al. | |
| 10,151,198 | B2 | 12/2018 | Sira et al. | |
| 12,012,848 | B2 * | 6/2024 | Sperle | E21B 43/38 |
| 2011/0257887 | A1 | 10/2011 | Cooper et al. | |
| 2017/0370210 | A1 | 12/2017 | Nyhavn et al. | |
| 2025/0003332 | A1 * | 1/2025 | Drønen | E21B 47/11 |
| 2025/0020042 | A1 * | 1/2025 | Zhu | F16K 31/36 |

* cited by examiner 100
122
D
126a
100a
C
124b
124a
140
B
118
130
120
A
114
116
126b
124
D
C
B
A 120a
120b
19
120c
Section cut A-A 21
23
Section cut B-B 126a
127
126b
Section cut C-C 126a
127
126b
Section cut D-D

METHOD AND APPARATUS FOR QUANTITATIVE MULTI-PHASE DOWNHOLE SURVEILLANCE

The present invention relates to monitoring flow from a production well, and in particular to apparatus and methods for measuring total production rate in the well of two separate phases. Aspects of the invention include measuring total production rate for oil and water phases, gas and water phases or oil and gas phases.

BACKGROUND TO THE INVENTION

Permanent tracers installed in producer wells have been proven for estimating "what flows where and how much", i.e. which fluids flow in which parts of the well, and at which flow rates. Traditionally, different tracers have been placed in different influx zones to a production completion installed in a well.

Methods of monitoring fluid rate in a well are known, including quantification based on transient flow where distinct tracers are arranged at different influx zones in a well. The well is shut-in for a period of time to allow a high concentration of tracers to build up at the individual influx zones, and then the well is restarted to carry the tracers to surface. Sampling and analysis of the concentration of the different tracers is used to provide qualitative and quantitative production data.

EP2633152 discloses a method of estimating influx profile for well fluids (oil, gas, or water) to petroleum well with influx locations to a production flow. The method comprises arranging tracer sources with tracer materials in levels of the well and inducing a transient in the production rate of the entire production flow by shutting in the well. The method comprises collecting and analysing samples and based on said concentrations and their sampling sequence and the well geometry, calculating influx volumes from flow models.

However, these methods limit the number of opportunities for obtaining tracer data, as shutting in the well is a complex and highly expensive operation requiring significant project planning and resulting in loss of revenue due to interruption to production.

Tracer injection systems for downhole use are described in U.S. Pat. No. 6,840,316 B2 and WO2016137328A1. Tracer is typically injected into the main flow path of the well. However, WO2016137328A1 describes a tracer release system with a shunt chamber and a flow restrictor.

A common problem of the known tracer injection techniques is that the injected tracers are added to the production flow and there is limited control whether the tracers are exposed to the target fluid or not. This presents uncertainties in the analysis preformed topside.

Due to complexity of the multi-phase flow there are no tracer-based techniques to accurately measure zonal flow rates of different phases. Some of the challenges in multi-phase conditions are related to the fact that water presence is not proportional to the production due to slip and gravity differences.

SUMMARY OF THE INVENTION

It is an object of an aspect of the present invention to provide a method and an apparatus for quantitative downhole surveillance of a multi-phase flow in a petroleum well.

It is a further object of an aspect of the present invention to provide a shunt chamber apparatus capable of improved quantitative multi-phase downhole petroleum surveillance by measuring production rate of each phase in a multi-phase flow.

Further aims and objects of the invention will become apparent from reading the following description.

According to a first aspect of the invention there is provided a method for quantitative downhole surveillance of a multi-phase flow, comprising at least two phases of either oil, water or gas, in a petroleum well, the method comprising;

providing at least one shunt chamber comprising;
- a flow phase separation section;
- a tracer chamber;
- one or more outlet ports;
- at least one flow restrictor;
- a tracer system with one or more tracers;

separating a shunt flow in the shunt chamber into a low-density flow phase and a high-density flow phase;

releasing at least one tracer into the tracer chamber;

passing the separated low-density flow phase and high-density flow phase through each flow restrictor;

flushing out the low-density phase flow and the high-density phase flow with the tracer from the shunt chamber through the outlet ports into the local flow inside the well;

conducting monitoring of tracer in the production flow at a detection point downstream of the outlet ports.

The method may comprise measuring the concentration of the one or more tracers in the monitored flow.

By providing at least one shunt chamber capable of releasing or flushing out tracer into the production flow may create a tracer transient. The tracer molecules propagate downstream with production flow as a tracer cloud, slug or shot which may be detectable downstream of the apparatus and/or topside as tracer response signal or spike at the downstream detection point.

The tracer transients are driven by the velocity field in the well. The topside arrivals of the onset of the different tracers, or the full transient of the different tracers, can be used to estimate the downhole velocity field. From the velocity field the inflow profile may be calculated.

The method may comprise flushing out the low-density phase flow and the high-density phase flow with the tracer in the form of a tracer cloud.

The method may be conducted in substantially horizontal, a sloping and/or a slightly aslant well design. The method may be conducted for one or more positions in the well. The may be conducted for one more tracer source position. There may be one or more local multiphase flows inside the well.

The method may comprise a portion of the shunt flow entering a locally arranged shunt chamber. The method may comprise directing a portion of local flow to shunt chamber.

The method may comprise separating shunt flow into low density flow phase and high density flow phase in the flow phases separation section before entering the delay chamber or at least one flow restrictor.

The method may comprise separating shunt flow into low density flow phase and high density flow phase in the flow phases separation section before adding the tracer.

The method may comprise adding the tracer before separating shunt flow into low density flow phase and high density flow phase in the flow phases separation section.

The method may comprise separating shunt flow into low density flow phase and high density flow phase in the flow phases separation section before releasing the tracer or exposing the flow to the tracer.

The method may comprise releasing at least one tracer into the shunt flow or exposing the flow to the tracer before separating shunt flow into low density flow phase and high density flow phase in the flow phases separation section.

The flow restrictors may be fluid and/or phase specific. The tracer chamber may have a predefined chamber volume. The at least one shunt chamber may be arranged for one or more tracer source positions in the well.

The at least one shunt chamber may comprise a first flow restrictor for a low-density flow phase and a second flow restrictor for a high-density flow phase. The low-density flow phase may be a hydrocarbon phase. The high-density flow phase may be a water phase. In some cases, the low-density flow phase may be a water phase. The high-density flow phase may be a. hydrocarbon phase such as in heavy oils.

The at least one shunt chamber may comprise one or more inlet ports. The shunt flow may be separated into a low-density phase and a high-density phase after the shunt flow enters the inlet ports. The one or more inlet ports may be arranged upstream of one or more outlet ports.

The method may comprise moving and/or aligning the at least one flow restrictor with the separated low-density flow phase and/or high-density flow phase. The method may comprise setting the position of the at least one flow restrictor to allow separated low-density flow phase and/or high-density flow phase to pass through the at least one flow restrictor.

The at least one flow restrictor may be a restrictor for low density flow phase. The at least one flow restrictor may be a restrictor for high density flow phase. The shunt chamber may comprise a first flow restrictor for a low-density flow phase and a second flow restrictor for a high-density flow phase. The method may comprise setting the position of the at least one flow resistor and passing the separated low-density flow phase through the aligned restrictor for low density flow phase. The method may comprise setting the position of the at least one flow resistor and passing the separated high-density flow phase through the aligned restrictor for high density flow phase.

The tracer system may be activated to release the at least one tracer into the chamber to form a tracer cloud, or several discrete clouds in the same chamber. The tracer cloud may have a tracer concentration higher than the background concentration of tracers.

The at least one shunt chamber may comprise at least one valve configured to selectively control the flow of fluid through the one or more outlets ports. The at least one shunt chamber may comprise at least one valve configured to selectively control the flow of fluid through the one or more outlets ports.

The method may comprise flushing out the low-density phase flow and the high-density phase flow with the tracer from the shunt chamber through the outlet ports into the local flow inside the well. The method may comprise flushing out the tracer in the form of a tracer cloud.

The method may comprise opening the at least one valve and flushing tracer from the flow passage and through the one or more outlet ports.

The method may comprise opening and/or closing the at least one valve in response to changes in fluid velocity or fluid pressure in the well. The method may comprise opening and/or closing the valve in response to a pressure differential between the at least one fluid inlet and the at least one fluid outlet. The method may comprise opening and/or closing the valve in response to a pressure differential between the tracer chamber of the flow shunt chamber apparatus and the production tubing. The method may comprise opening and/or closing the at least one valve in response to a signal from surface.

The method may comprise opening the at least one valve to an intermediate position between the fully open and fully closed positions.

The method may comprise closing the at least one valve for a period of time to shut in the shunt chamber and increase the concentration of tracer particles or molecules released into the fluid volume of the delay chamber.

The method may comprise closing the at least one valve for a period of time sufficient to build up a high concentration of tracer in the shunt chamber that is detectable as a high amplitude tracer response signal at the detection point downstream when the tracer particles or molecules are released from the shunt chamber. By shutting in the shunt chamber one or more tracer clouds may be formed. A tracer cloud is a local increased or high concentration of tracer molecules that when released into the flow may be detectable as a high amplitude tracer response signal at the detection point downstream of the shunt chamber. The period of time may range from hours to months.

The at least one valve may be closed for less than 24 hours to shut in the shunt chamber. The at least one valve may be closed for more than 24 hours to shut in the shunt chamber apparatus.

The method may comprise using the differential pressure between the inlet ports and outlet ports to flush out tracer cloud from the shunt chamber.

The method may comprise calculating a characteristic flush-out time of each tracer from the tracer chamber, or travel time of each tracer through the shunt chamber based on concentration of the one or more tracers in the monitored flow.

The tracer chamber may be a delay chamber. The method may comprise using the predefined chamber volume, estimating pressure drop in the well between the inlet and outlet ports and/or calculating hold up and/or flow rates for each phase of the local multiphase flows.

The two separate phases may be oil and water, or gas and water, or oil and gas. For simplicity, it will be further referred mainly as oil and water combination of fluids and corresponding combination of oil and water affine tracers, but it should be regarded as any combination described above.

The method may comprise the steps of:

- inflow of well fluid into the shunt chamber through inflow ports,
- separation of the phases after entrance into the shunt chamber;
- introduction of the tracer cloud into the shunt chamber;
- wash-out of tracer cloud by the separated fluid flow from the shunt chamber back into the well through the outflow ports; and
- detection of the tracers at the detection point.

The collection, detection, analysis and/or interpretation of tracer data in production fluid may be separate methods from one another and performed at different times or jurisdictions. The detection, analysis and/or interpretation of tracer in production fluid may be separate methods to the separation of phases, release of tracer cloud from the shunt chamber and/or the collection of samples. Samples may be collected and the tracer detected, analysed and/or interpreted at a time or jurisdiction which is separate and distinct from the location of well and therefore the collection of the samples.

The shunt chamber may comprise inflow and outflow ports, a delay chamber; a tracer system to introduce tracers into the delay chamber, flow restrictor units for each phase and a section within the shunt chamber for where the separation of the phases may take place.

The method may comprise calculating production rates of each of the two phases may be based on the measured flush-out time of tracers from the delay chamber or by the travel time of tracer in the delay chamber and known throughput of flow restrictor units for the given pressure difference between inflow and outflow ports. The method may comprise providing a pressure difference between inflow and outflow ports to force part of the well fluids to flow through the delay chamber and flow restrictor units.

The method may utilise tracers with affinity to the target two phases which are detectable either online or by the fluid analysis after sampling. The method may utilise one or more phase specific tracers.

The method may comprise separating phases inside the shunt chamber and contacting each phase with a tracer and flowing through a known restrictor, designed for each phase. This means that the behaviour of each phase inside the shunt chamber is known and the velocity will be proportional to the differential pressure from inlet to outlet of the shunt chamber inside the tube such as base pipe, i.e. in the production flow.

The method may comprise driving the separated flows through the shunt chamber using differential pressure. The amount of each separated phase inside the chamber and the design of the restrictor may set the duration of the tracer trace at the monitoring point, seen as a concentration value. One may get a long-lasting tracer trace signal.

The method may comprise adding tracer to a still unseparated flow portion in the delay chamber. The method may comprise adding tracer to each different phase after the flow has separated.

The method may comprise using tracers that have affinity to one or more fluid phases. i.e. tracers to hydrocarbon phases such as oil or gas and tracers to water phase.

The method may comprise using neutral tracers that have affinity to both phases and the signal, tracer trace, may be read according to the set restriction properties and expected behaviour of phases through the shunt chamber and the well, having different time constants.

The method may utilise tracers with affinity to the target two phases which are detectable either online or by the fluid analysis after sampling. The two separate phases can be oil and water, or gas and water, or oil and gas.

By measuring travel time or flush out time, knowing the well geometry and the shunt chamber geometry one may calculate the proportion of the target fluid at the shunt chamber position, pressure differences, hold up through the well, and production rates, among others.

The method may use the predefined chamber volume, estimating pressure drop in the well between the inlet and outlet ports. The method may comprise calculating hold up and/or flow rates for each phase of the local multiphase flows.

The method may comprise enabling or directing the shunt flow to enter the shunt chamber from an annulus space of a production tubing in the well. The method may comprise enabling or directing the shunt flow to enter the shunt chamber from inside a production tubing in the well. The shunt flow may be a local shunt flow. The shunt flow may be a portion of local flow of shunt flow.

The method may comprise aligning the at least one restrictor unit with the low density phase, which may be an upper or high position in the shunter chamber. The method may comprise aligning the at least one restrictor unit with the high density phase which may be a lower or low position in the shunt chamber. The method may comprise aligning the at least one restrictor unit before enabling or directing a portion of the shunt flow to enter the shunt chamber.

The method may comprise triggering an opening of a sealing device of the inlet and/or outlet ports. The method may comprise triggering an opening of a sealing device of the inlet and/or outlet ports before a portion of the shunt flow enters the shunt chamber.

The method may comprise enabling or directing the tracers to enter the delay chamber and forming an increased or elevate concentration of tracer to form a tracer cloud before the flow enters the flow restrictors. The method may comprise releasing the tracers into the delay chamber and forming a tracer cloud before entering the flow restrictors.

The method may comprise triggering the tracer releasing system to release tracer from the polymer matrix, the tracer liquid or solid injector, releasing tracers from matrix and or injecting tracers by an injector or releasing from a container.

The method may comprise the tracer releasing system releasing a first dose of at least one of the tracers to a first end of the delay chamber and second dose of at least one of the tracers to a second end of the delay chamber simultaneously.

The one or more local multiphase production flows may be the sum of annulus spaced flow through the shunt chamber and the inside base pipe volume. The tracer concentration may be at least two times the background concentration of the tracers.

The method may comprise monitoring by in-flow stream detection, probe detection, clamp on measurement or executed by physical sampling.

The tracer releasing system may be triggered for, at a given time, releasing at least a dose of at least one of the tracers.

The inlet ports may be opened for enabling the shunt flow to enter the shunt chamber. The inlet ports may be closed to trigger a tracer release signal, to form a tracer cloud by holding the ports closed for a pre-set time. The inlet ports may be subsequently opened to drive the shunt flow through the shunt chamber by differential pressure.

The method may comprise providing two or more shunt chamber each with a distinct tracer at known different locations in the well. Each shunt chamber may be arranged downstream of a different influx zone and exposed to the fluids from influx zone.

According to a second aspect of the invention there is provided a method for quantitative downhole surveillance of a multi-phase flow, comprising at least two phases of either oil, water or gas, in a petroleum well, the method comprising

- providing at least one shunt chamber comprising
  - a flow phase separation section;
  - a tracer delay chamber,
  - one or more inlet ports and one or more outlet ports, the inlet ports arranged upstream of—the outlet ports;
  - at least one flow restrictor;
  - a tracer releasing system with one or more tracers;
- separating a shunt flow into shunt chamber into a low-density flow phase and a high-density flow phase;
- activating the tracer releasing system to release at least one tracer into the delay chamber;
- the separated low-density flow phase and high-density flow phase flowing through each flow restrictor;
- flushing out the low-density phase flow and the high-density phase flow with the tracer cloud from the shunt chamber through the outlet ports into the local flow inside the well, conducting monitoring of tracer in the production flow at a detection point downstream of the outlet ports.

The method may be conducted in a substantially horizontal, a sloping and/or a slightly aslant well design. The method may be conducted for one or more positions in the well. The may be conducted for one more tracer source position. There may be one or more local multiphase flows inside the well.

Embodiments of the second aspect of the invention may include one or more features of the first aspect of the invention or its embodiments, or vice versa.

According to a third aspect of the invention there is provided a shunt chamber apparatus for quantitative multiphase downhole petroleum surveillance wherein the apparatus comprises;

a flow shunt chamber for a shunt flow comprising;

one or more outlets, a flow phase separation section to separate the shunt flow into a low-density flow phase and a high-density flow phase, a tracer delay chamber;

a tracer releasing system for at least one tracer; and at least one flow restrictor in fluid communication with the delay chamber.

The flow shunt chamber may have an elongated body. The flow shunt chamber may have an at least partial cylindrical body. The flow shunt chamber may be designed for circumferential arrangement in a petroleum well.

Preferably the flow shunt chamber comprises one or more inlets. The one or more inlets may be inlet ports. The one or more outlets may be outlet ports. The one or more inlets may be arranged in an upstream portion and the one or more outlets may be arranged in a downstream portion of the tracer shunt chamber respectively.

The at least one tracer may have affinity to one or more petroleum flow phases.

The at least one flow restrictor may be phase specific. The at least one flow restrictor may be a low-density phase flow restrictor. The at least one flow restrictor may be a high-density phase flow restrictor.

The flow shunt chamber may comprise at least one low density phase flow restrictor and at least one high density phase flow restrictor in fluid communication with the delay chamber. The flow restrictors may have a predefined restriction efficiency.

The at least one flow restrictor may be configured to spread tracers over sufficiently large well fluid volume such that the tracer signal may be captured at a detection point topside or downhole with the available measurement resolution or sampling frequency at the detection point. The design of the chamber, the use of delay chamber, and flow restrictor which facilitates the separation of two phases and predictable flush-out rate for each phase.

The flow shunt chamber may comprise at least one valve configured to selectively control the flow of fluid through the one or more inlets and/or the one or more outlets. The at least one valve may be configured to selectively open and close the one or more fluid inlets and/or the one or more outlets to control the flow of fluid through the one or more fluid inlets and/or the one or more outlets.

The at least one valve may be configured to selectively open and close the one or more fluid inlet between a fully open position, a fully closed position, or to an intermediate position between the fully open and fully closed position. The at least one valve may be configured to selectively open and close the one or more fluid outlet between a fully open position, a fully closed position, or to an intermediate position between the fully open and fully closed position. The at least one valve may be operated to control flow and vary the area of openings for flow through the one or more inlets and/or through the one or more inlets.

The at least one valve may be an electrically actuated valve, a mechanical valve and/or thermodynamic valve. The at least one valve may be configured to selectively open and/or close in response to a well event.

The at least one valve may be configured to selectively open and/or close in response to a signal from surface. The valve may be configured to selectively open and/or close in response to a change in temperature, pressure and/or velocity. The at least one valve may be configured to selectively open and/or close in response to at least one electronic signal.

The at least one valve may be configured selectively open and/or close in response a change in fluid velocity or fluid pressure in the well and/or production tubing.

The at least one valve may be a differential pressure operated valve. The valve may be configured to selectively open and/or close in response to a pressure differential across the valve.

The at least one valve may be configured to selectively open and/or close in response to changes in fluid pressure in the well. The valve may be configured to selectively open and/or close in response to a pressure differential between the at least one fluid inlet and the at least one fluid outlet. The valve may be configured to selectively open and/or close in response to a pressure differential between the flow shunt chamber apparatus and the production tubing.

The at least one valve may be a velocity valve. The at least one valve may be configured to selectively open and/or close in response to changes in fluid velocity in the production flow. The at least one valve may be set to be normally open or normally closed. The at least one valve may be a flapper valve or a sleeve valve.

The at least one valve may be an electrically actuated valve. The at least one valve may be configured to selectively open and/or close in response to receiving at least one electric or electronic signal. The at least one valve may be wired or wirelessly controlled. The signal to control the actuation of the valve may be from the surface or from some other external source. The at least one valve may comprise or be connected to a wireless communication system.

The wireless communications system may comprise at least one wireless receiver capable of wirelessly receiving data to control and operate the electrically actuated valve. The wireless communications system may comprise at least one transmitter to transmit a signal such as from surface.

The at least one valve may be adjustable and/or settable to be normally open or normally closed. Preferably the valve is configured to react to the fluid velocity or fluid pressure in the well.

The at least one valve may be set to open and/or close at a predetermined fluid velocity or fluid pressure rate of flow. The at least one valve may be configured to have at least one actuation threshold level. The at least one valve may be set to partially open and/or partially close the valve. The valve may be configured to open and/or close the at least one valve at intermediate positions between fully open and fully closed.

The at least one valve may comprise a biasing mechanism. The at least one valve may be balanced or biased by a biasing mechanism which is configured to set the valve with a pre-determined fluid velocity or fluid pressure level which must be reached before the valve is actuated. The biasing mechanism may be a spring. The biasing mechanism may be a coil spring, a wave spring or a gas spring such as a nitrogen gas spring.

The biasing mechanism may be adjusted to set the actuation threshold of the valve. Preferably the at least one valve is a biased by a spring which may be adjustable by changing the type, length or tension of the spring. The actuation threshold of the valve may be set.

The flow shunt chamber apparatus may be retrofitted into an existing tubing. The flow shunt chamber apparatus may be retrievable, installed, replaced and/or adjusted by wireline, slickline, coiled tubing, drill pipe or similar conveyance.

The flow shunt chamber apparatus or a component of the flow shunt chamber apparatus may be installed or replaced and may be conveyed through the production tubing by wireline, slickline, coiled tubing, drill pipe or similar conveyance. The flow shunt chamber apparatus may be conveyed onto at least one landing nipple. The at least one landing nipple may have ports in communication with the production tubing and/or the annulus.

The at least one valve may be installed or replaced and may be conveyed through the production tubing by wireline, slickline, coiled tubing, drill pipe or similar conveyance. The at least one valve may be conveyed onto at least one landing nipple. The at least one landing nipple may have ports in communication with the production tubing and/or the annulus.

The valve settings of the at least one valve may be adjusted via direct connection from surface to the valve. The valve settings may be adjusted via an intervention operation by lowering an intervention device by wireline, slickline, coiled tubing, drill pipe or similar conveyance to manipulate and adjust the setting on the at least one valve.

The flow shunt chamber apparatus may comprise an inlet valve at the at least one inlet to control the flow of fluid through the at least one inlet. The flow shunt chamber apparatus may comprise an outlet valve to control the flow of fluid through the at least one outlet.

The inlet valve and the outlet valve may be configured to act independently of one another. The inlet valve and the outlet valve may be configured to act in co-operation with one another. The inlet valve and the outlet valve may be configured such that the one valve acts as a master valve and the other valve acts as a slave valve.

Preferably the fluid inlet and a fluid outlet are in fluid communication with the production tubing. The production tubing may be an inner pipe into which production fluid enters in the production zone. The production tubing may extend from downhole to surface.

The flow restrictors may have an alignment arrangement for positioning according to low density phase, upper, and high density phase, lower, positions in the shunt chamber. The alignment arrangement may be a gravity controlled system. The at least one restrictor may be arranged in a rotating ring portion insert for independently rotation. The ring portion may be arranged on bearings between the ring portion insert and fixed parts of the shunt chamber. The alignment arrangement may be a plugging arrangement in combination with more possible restrictors arranged in the circumference of the shunt chamber.

A plurality of flow restrictors may be arranged in the circumference of a portion of the shunt chamber wherein the flow restrictors may be arranged with plugging means and a trigger for alignment. The method may comprise activating the plugging means for keeping the highest positioned restrictor and the one which has the lowest position in the circumference to act as flow restrictors.

The shunt chamber arrangement may be arranged as a section of a production tubing. The shunt chamber arrangement may be arranged for retrofit installation. The body may be cylindrical and for co-axial arrangement to a base pipe, production tubing, casing in the well.

The one or more inlet ports may be arranged with apertures to the flow inside the production tubing. The one or more inlet ports may be arranged open to the flow outside the production tubing, to the annulus, gravel pack etc. The one or more inlet ports may be arranged with apertures to the flow outside the production tubing and to the flow inside the production tubing. The one or more outlet ports may be arranged with apertures to the flow inside the production tubing. The outlet ports may be arranged open to the flow outside the production tubing, to the annulus, gravel pack etc. The outlet ports may be arranged with apertures to the flow outside the production tubing and to the flow inside the production tubing.

The flow restrictors may be elongated tubes. The flow restrictors may be elongated narrow tubes.

The tracer release system may be a mechanical release system for releasing a dose of the tracer. The tracer release system may be tracer injection system. The tracer releasing system may be a tracer matrix carrier system. The tracer may be a solid, liquid or gas. The tracer may be selected from the group comprising chemical, fluorescent, phosphorescent, magnetic, DNA and/or radioactive compounds.

The tracer may comprise chemical tracers selected from the group comprising perfluorinated hydrocarbons or perfluoroethers. The perfluorinated hydrocarbons may be selected from the group of perfluoro buthane (PB), perfluoro methyl cyclopentane (PMCP), perfluoro methyl cyclohexane (PMCH).

The tracer may be chemically immobilized within and/or to the tracer delay chamber. The tracer may comprise tracer molecules and a carrier. The carrier may be a matrix material. The matrix material may be a polymeric material.

The tracer molecules may be chemically immobilized within and/or to the carrier. The tracer molecules may be chemically immobilized by a chemical interaction between the tracer and the carrier.

By varying the chemical interaction between the tracer and the polymer the release mechanism and the rate of release of tracer molecules from the tracer material may be controlled. Preferably the tracer is released from the tracer carrier with an even release rate.

The carrier may be selected from poly methyl methacrylates (PMMA), poly methylcrylates, poly ethylenglycols (PEG), poly lactic acid (PLA) or poly glycolic acid (PGA) commercially available polymers or copolymers thereof. The carrier may be selected from polymers with higher rates of tracer molecules release such as polyethylene and polypropylene.

The tracer may be physically dispersed and/or physically encapsulated in the carrier.

The tracer may release tracer molecules into fluid by dissolution or degradation of the carrier and/or the tracer into the fluid. The carrier may be selected to controllable degrade on contact with a fluid. The carrier may be selected to degrade by hydrolysis of the carrier.

The tracer and/or the carrier may be fluid specific such that the tracer molecules will be released from the tracer as a response to a contact with a target liquid.

The tracers and/or the carrier may be chemically intelligent such that tracer molecules will be released from the tracer as a response of specific events, e.g. they respond to an oil flow (oil-active) but show no response to a water flow (water-resistant). Another group of chemical compounds can be placed in the same region, which release tracers in water flow (water-active) but show no response to an oil flow (oil-resistant).

The tracer molecules may be detected and its concentration measured by different techniques such as optical detection, optical fibers, spectrophotometric methods, PCR techniques combined with sequential analysis, chromatographic methods or radioactivity analysis. The invention is not restricted to the above-mentioned techniques.

The tracer molecules may be detected and its concentration measured by sampling production fluid. The sampling may be conducted at the one or more of said sampling times. The sampling may be conducted downhole downstream of the shunt chamber apparatus or at surface. Samples may be collected for later analysis.

Samples may be collected and/or measured downstream at known sampling times. Based on the measured concentrations and their sampling sequence and the well geometry the influx volumes may be calculated. The method may comprise estimating or calculating an influx profile based on the concentration and type of tracer as a function of the sampling time.

The influx volumes may be calculated from transient flow models. The influx volumes may be used to estimate an influx profile of the well.

The tracer molecules may be detected by a detection device such a probe. The detection device may facilitate real time monitoring and/or analysis of the tracer in the production fluid.

The tracer may be disposed in the tracer delay chamber to allow fluid to contact the tracer as it passes around the tracer material in the tracer chamber.

The tracer may be configured to selectively release tracer molecules from the tracer material into a fluid into the tracer delay chamber on contact with a particular well fluid. Preferably the tracer is designed to release tracer molecules into the tracer chamber when the tracer I is exposed to a target fluid i.e. oil, gas or water.

Embodiments of the third aspect of the invention may include one or more features of the first or second aspects of the invention or their embodiments, or vice versa.

According to a fourth aspect of the invention there is provided a shunt chamber apparatus for quantitative multi-phase downhole petroleum surveillance wherein the apparatus comprises;

a flow shunt chamber for a shunt flow comprising;

one or more outlets;

a flow phase separation section to separate the shunt flow into a low-density flow phase and a high-density flow phase;

a tracer delay chamber;

a tracer releasing system for at least one tracer; and at least one flow restrictor in fluid communication with the delay chamber; and at least one valve configured to selectively control the flow of fluid through the one or more outlets.

The shunt chamber apparatus may comprise one or more inlets. The at least one valve may be configured to selectively control the flow of fluid through the one or more inlets.

Embodiments of the fourth aspect of the invention may include one or more features of any of the first to third aspects of the invention or their embodiments, or vice versa.

According to a fifth aspect of the invention there is provided a method for quantitative downhole surveillance of a multi-phase flow, comprising at least two phases of either oil, water or gas, in a petroleum well, the method comprising;

providing at least one shunt chamber comprising;

a flow phase separation section;

a tracer chamber;

one or more outlet ports;

at least one flow restrictor;

a tracer system with one or more tracers;

at least one valve configured to selectively control the flow of fluid through the one more outlets;

separating a shunt flow in the shunt chamber into a low-density flow phase and a high-density flow phase;

releasing at least one tracer into the tracer chamber;

passing the separated low-density flow phase and high-density flow phase through each flow restrictor;

opening the at least one valve;

flushing out the low-density phase flow and the high-density phase flow with the tracer cloud from the shunt chamber through the outlet ports into the local flow inside the well, conducting monitoring of tracer in the production flow at a detection point downstream of the outlet ports.

Embodiments of the fifth aspect of the invention may include one or more features of any of the first to fourth aspects of the invention or their embodiments, or vice versa.

According to a sixth aspect of the invention there is provided a method for quantitative downhole surveillance of a multi-phase flow, comprising at least two phases of either oil, water or gas, in a petroleum well, the method comprising;

providing at least one shunt chamber comprising;

a flow phase separation section;

a tracer chamber;

one or more outlet ports;

at least one flow restrictor;

a tracer system with one or more tracers;

at least one valve configured to selectively control the flow of fluid through the one more outlets;

separating a shunt flow in the shunt chamber into a low-density flow phase and a high-density flow phase;

passing the separated low-density flow phase and high-density flow phase through each flow restrictor;

closing the at least one valve for a period of time to shut in the shunt chamber;

opening the at least one valve to release tracer molecules;

flushing out the low-density phase flow and the high-density phase flow with the tracer cloud from the shunt chamber through the outlet ports into the local flow inside the well;

conducting monitoring of tracer in the production flow at a detection point downstream of the outlet ports.

Embodiments of the sixth aspect of the invention may include one or more features of any of the first to fifth aspects of the invention or their embodiments, or vice versa.

According to a seventh aspect of the invention there is provided a method for quantitative downhole surveillance of a multi-phase flow, comprising at least two phases of either oil, water or gas, in a petroleum well, the well, at tracer source positions being substantially horizontal and/or a slightly aslant well design, comprising:

one or more tracer source positions having one or more local multiphase flows inside the well;

letting a portion of the local flow, a shunt flow enter a locally arranged shunt chamber the shunt chamber comprising;

a flow phase separation section;

a tracer delay chamber of predefined chamber volume;

one or more inlet ports and one or more outlet ports, the inlet ports arranged upstream the outlet ports;

at least a first flow restrictor for a low density flow phase and a second flow restrictor for a high density flow phase;

one or more tracer releasing system;

one or more tracers having affinity to one or more fluid phases;

after the shunt flow entering the inlet ports letting the shunt flow separate into a low density flow phase, generally the hydrocarbon phase, and a high density flow phase, generally the water phase;

triggering the tracer releasing system for releasing at least a dose of at least one of the tracers to the delay chamber for forming a tracer cloud, or several discrete clouds in the same chamber, with tracer concentration higher than the background concentration of tracers;

the separated low density flow phase and high density flow phase, i.e. water and oil phases or gas and oil phase, flowing through each appurtenant flow restrictor, before using the differential pressure between said inlet ports and said outlet ports out the low density phase flow and the high density phase flow with the tracer cloud from the shunt chamber through the outlet ports (into the local flow inside the well;

conducting monitoring of flow from tracer responses in the production flow at a detection point downstream the outlet ports; and calculating a characteristic flush-out time of each tracer the shunt chamber, or travel time of each tracer through the shunt chamber based on concentration of the one or more tracers in the monitored flow.

One or more tracers may be added to an unseparated flow portion in the delay chamber or after the flows has allowed to separate and then add tracers into each different phase.

The tracers may have affinity to one or more fluid phases, such as tracers to hydrocarbon phases such as oil or gas and tracers to water phase.

One may also use neutral tracers that have affinity to both phases and the signal, tracer trace, may be read according to the set restriction properties and expected behaviour of phases through the shunt chamber and the well, having different time constants.

The use of a system without separating the phases and having only a common restrictor unit could not take advantage of a neutral tracer. This may be advantageously when it comes to the tracer release system inside the shunt chamber and also with regards to number of available or possible tracers.

The method may comprise using a water tracer and a neutral tracer in combination instead of a water and oil tracers for a water and oil system.

The method may use the predefined chamber volume, estimating pressure drop in the well between the inlet and outlet ports.

The method may comprise calculating hold up and/or flow rates for each phase of the local multiphase flows.

Embodiments of the seventh aspect of the invention may include one or more features of any of the first to sixth aspects of the invention or their embodiments, or vice versa.

According to an eighth aspect of the invention there is provided a shunt chamber tracer release arrangement for quantitative multi-phase downhole petroleum surveillance wherein the flow shunt chamber for a shunt flow has an elongated at least partial cylindrical body for arrangement in a petroleum well and comprising;

one or more inlet ports and one or more outlet ports arranged in an upstream portion and a downstream portion of the tracer shunt chamber respectively;

a flow phase separation section;

a tracer delay chamber;

a tracer releasing system for at least one tracer having affinity to one or more petroleum flow phases;

at least one low density phase flow restrictor; and a high density phase flow restrictor in fluid communication with the delay chamber the flow restrictors having a predefined restriction efficiency.

Embodiments of the eighth aspect of the invention may include one or more features of any of the first to seventh aspects of the invention or their embodiments, or vice versa.

According to a ninth aspect of the invention there is provided an interpretation method for quantitative multiphase downhole surveillance for a petroleum well with a production flow in a well comprising;

providing data from a producing well having at least one shunt chamber with separated flow phases through separate flow restrictors for one or more tracer positions; and one or more local multiphase production flows;

wherein the data comprises measurements of tracers in the production flow at a detection point (D) downstream delay chambers to determine tracer concentration values for the one or more tracers; and calculating the characteristic flush-out time or travel time for the separated phases in the delay chambers based on the tracer concentration.

The interpretation method may comprise using known chamber volume and known restriction efficiencies for said flow restrictors, estimating pressure drop in the base pipe and calculating hold up for the monitored locations.

The interpretation method may comprise using known chamber volume and known restriction efficiencies for said flow restrictors, estimating pressure drop in the base pipe and calculating the flow rates for each phase for the monitored locations.

Embodiments of the ninth aspect of the invention may include one or more features of any of the first to eighth aspects of the invention or their embodiments, or vice versa.

According to a tenth aspect of the invention there is provided a method of releasing at least one tracer into a multi-phase flow, comprising at least two phases of either oil, water or gas, in a petroleum well, the method comprising;

providing at least one shunt chamber comprising, a flow phase separation section;

a tracer chamber;

one or more outlet ports;

at least one flow restrictor;

a tracer system with one or more tracers;

separating a shunt flow in the shunt chamber into a low-density flow phase and a high-density flow phase;

releasing at least one tracer into the tracer chamber;

passing the separated low-density flow phase and high-density flow phase through each flow restrictor;

flushing out the low-density phase flow and the high-density phase flow with the tracer cloud from the shunt chamber through the outlet ports into the local flow inside the well.

Embodiments of the tenth aspect of the invention may include one or more of any of features of the first to ninth aspects of the invention or their embodiments, or vice versa.

According to an eleventh aspect of the invention there is provided a method of collecting samples for analysis in monitoring a multi-phase flow well, the method comprising;

providing at least one shunt chamber comprising;

a flow phase separation section;

a tracer chamber;

one or more outlet ports;

at least one flow restrictor;

a tracer system with one or more tracers;

separating a shunt flow in the shunt chamber into a low-density flow phase and a high-density flow phase;

releasing at least one tracer into the tracer chamber, passing the separated low-density flow phase and high-density flow phase through each flow restrictor;

flushing out the low-density phase flow and the high-density phase flow with the tracer cloud from the shunt chamber through the outlet ports into the local flow inside the well; and collecting samples at a location downstream of the at least one shunt chamber.

Embodiments of the eleventh aspect of the invention may include one or more of any of features of the first tenth aspects of the invention or their embodiments, or vice versa.

According to a twelfth aspect of the invention there is provided a method for quantitative downhole surveillance of a multi-phase flow comprising at least two phases of either oil, water or gas, in a petroleum well;

wherein the well comprises at least one shunt chamber comprising;

a flow phase separation section;

a tracer delay chamber;

one or more outlet ports;

at least one flow restrictor;

a tracer system with one or more tracers;

providing samples collected from the production flow at a location downstream of the at least one shunt chamber at known sampling times;

measuring tracer concentration for the one or more tracers in the samples;

calculating the characteristic flush-out time or travel time for the separated phases in the tracer delay chamber based on the tracer concentration.

Embodiments of the twelfth aspect of the invention may include one or more of any of features of the first to eleventh aspects of the invention or their embodiments, or vice versa.

According to a thirteenth aspect of the invention there is provided a method for quantitative downhole surveillance of a multi-phase flow comprising calculating the characteristic flush-out time or travel time for the separated phases based on measured tracer concentrations for one or more tracers in samples collected from the production flow at a location downstream of at least one shunt chamber at known sampling times.

Embodiments of the thirteenth aspect of the invention may include one or more of any of features of the first to twelfth aspects of the invention or their embodiments, or vice versa.

BRIEF DESCRIPTION OF THE DRAWINGS

There will now be described, by way of example only, various embodiments of the invention with reference to the following drawings (like reference numerals referring to like features) in which.

DETAILED DESCRIPTION OF PREFERRED EMBODIMENTS

Figure 1:
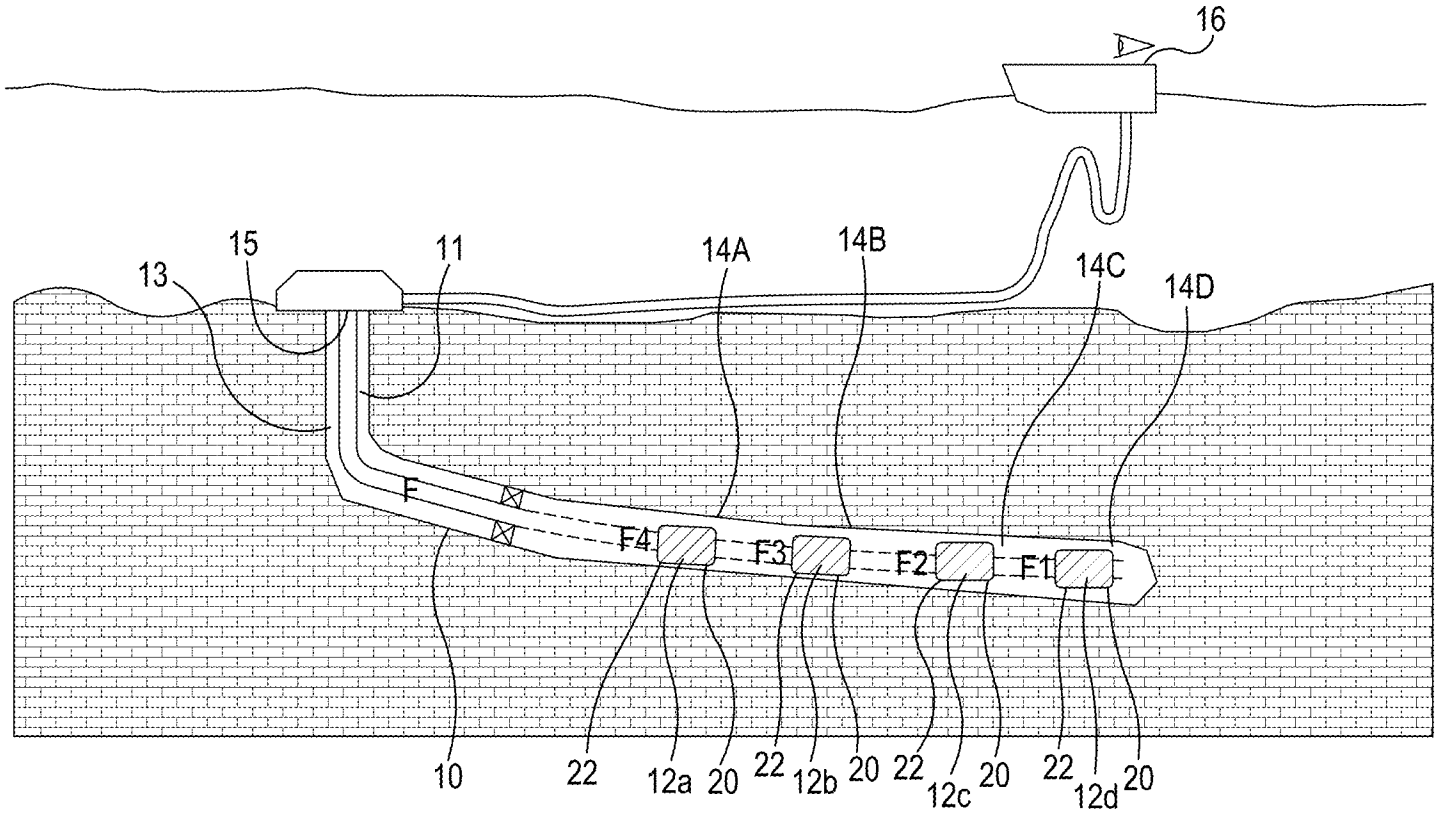
FIG. 1 is a simplified illustration of a petroleum well with shunt chambers according to an embodiment of the invention. The figure illustrates an embodiment having four shunt chambers placed out in the horizontal part of the well or in a slightly inclined section.

FIG. 1 is a simplified section through a production well 10. A central production tubing 11 is arranged in the well surrounded by annulus 13. Influx volumes of fluids enter the well from a reservoir into the central production tubing 12 via separate influx locations. Shunt flow chambers 12 are installed in or on the production tubing and are arranged near each influx location. Tracers are released from the shunt chambers and measured at surface 16 to provide information on which influx locations are producing, multiphase conditions and the rates of influx. In this example, there are four shunt chambers 12*a*, 12*b*, 12*c* and 12*d*. However, there may be a different number of influx zones and/or shunt chambers than illustrated in FIG. 1. Each shunt chamber has inlets 20 and outlets 22

Figures 2A, 2B, 2C, 2D, 2E:
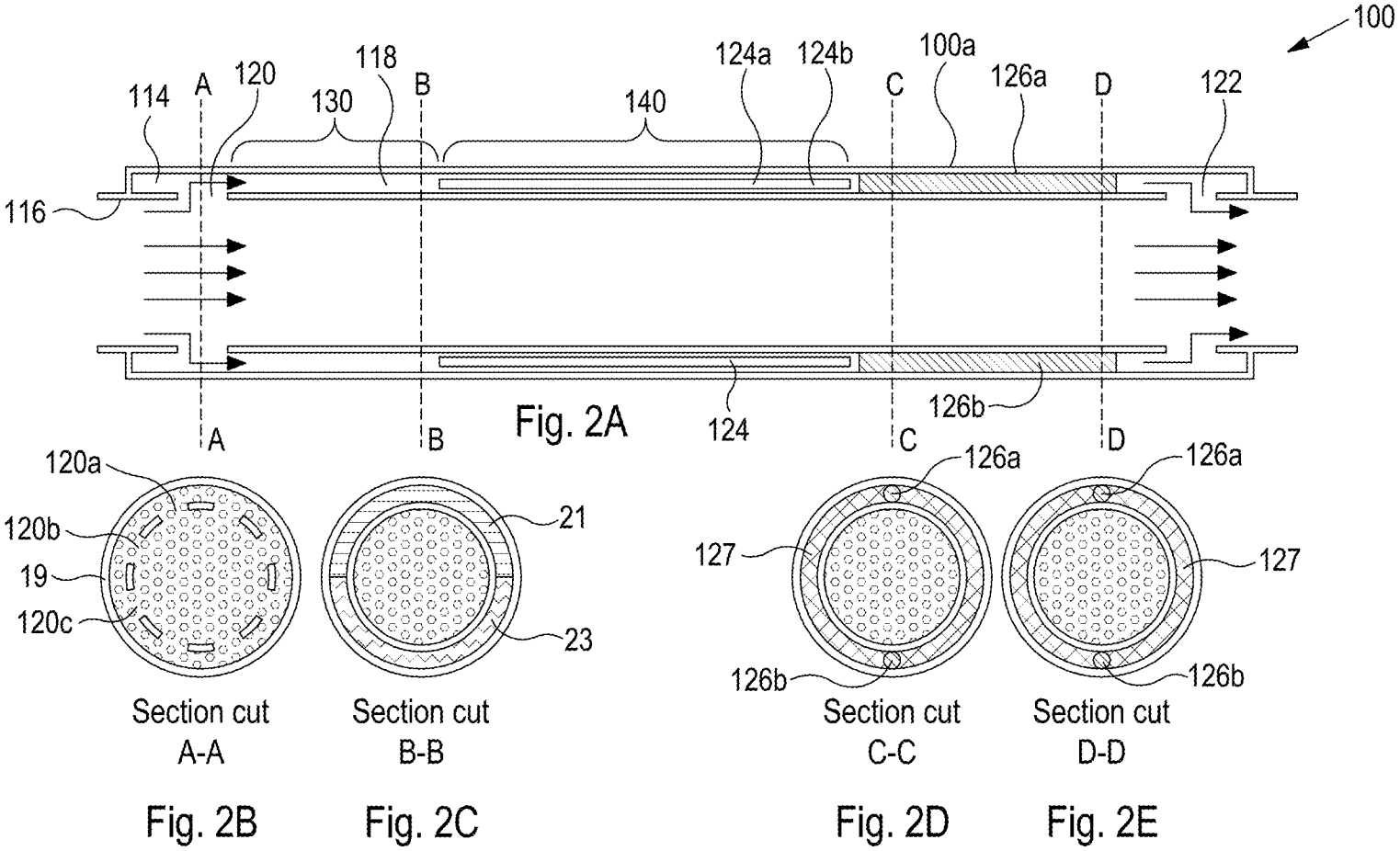
FIG. 2A illustrates a longitudinal sectional illustration of the shunt chamber according to an embodiment of the invention.
FIGS. 2B to 2E are sectional views along cut-lines A-A, B-B, C-C and D-D respectively of FIG. 2A.

FIG. 2A shows a shunt chamber 100 which has a tracer material 124 located in the shunt flow passage 118. The shunt chamber also comprises flow restrictors 126 in the shunt flow passage 118. In the example shown in FIG. 2A the flow restrictors 126 are located downstream of the tracer source. However as discussed below alternative configurations of the shunt chamber may be provided. The flow restrictors 126 are designed to be phase specific in that flow restrictor 126*a* restricts the flow of low-density fluids and flow restrictor 126*b* restricts the flow of high density fluids.

FIGS. 2B to 2E show section views along cut-lines A-A, B-B, C-C and D-D respectively of FIG. 2A. FIG. 2B shows the inlets 120 may be a number of openings around the base pipe, tube or the like (here an inward vented embodiment is illustrated). The inlet ports 120*a*, 120*b*, 120*c* may be one or more openings such as slits, holes, grids etc.

The shunt chamber 100 for a shunt flow—has an elongated at least partial cylindrical body 100*a* for accommodating a phase separation section 130. This section should allow the high density and low density phases to separate. In this example the separation section is at least partial circumferential, so that the heavy phase will move to the lower portion of the chamber and the fluid of lower density will lie on top. The separated phases will then flow, driven by the differential pressure between inlets 120 and outlets 122, through each appurtenant flow restrictors of known characteristic on its way through the shunt chamber.

Further with reference to the embodiment of the invention shown in FIG. 2A. The functionality of the invention is first given for single phase for simplicity and for introduction of terminology and later it is extended to the two-phase flow. For the single-phase flow it is as follows.

The fluid flow in the base pipe 116 creates the pressure difference between the inlet and outlet locations connecting the base pipe 116 and the shunt chamber 100 which is the annulus chamber 114 surrounding the base pipe.

This pressure difference between inlet and outlet drives part of the fluids through the shunt chamber 100 between the inlet and outlets. Tracer sources 124 are installed in the part of the shunt chamber called the delay chamber 140. Such tracer source produces a tracer cloud (concentration of predefined tracer higher than the background concentration) at a predefined event or on a command, or at a certain time or due to tracer accumulation after well shut-in if tracers are installed in the slowly releasing container. In this example the delay chamber 140 has an oil tracer source and water tracer source 124*b*. Details of such methods of installations and limitations will be discussed further below.

The fluid flow through the delay chamber moves the tracer cloud out of the shunt chamber and into the well through the outlets 122. Tracer dispersion while movement along the delay chamber creates a characteristic signal called flush-out signal. The flush-out signal has a peak concentration followed by the decay of the concentration. The decay of the concentration after the peak can be expressed by a slowly decaying function such as exponential function or power law function. The coefficient in the functions describing the steepness of the decay is proportional to the fluid velocity inside the delay chamber and thus the fluid velocity inside the delay chamber can be calculated based on the measured tracer concentration decay curve. Steeper curve, i.e., shorter flush-out time, corresponds to the higher fluid velocity inside the delay chamber.

The fluid flow through the shunt chamber 100 is proportional to the pressure difference between the inlet 120 and outlet ports 122 in the base pipe 116. The delay chamber 140 and the flow restrictors 126 are used to obtain the duration of the signal, tracer flush-out, which is possible to capture topside with available measurement time resolution or sampling frequency. In addition the signal should be long enough that it is not destroyed by the dispersion during the travel to the detection point which may be located after the upper completion and a long tie-back. The detection is performed by monitoring at a detection point that in one embodiment being downhole. The monitoring may also, or instead, be performed at a detection point 16 topside.

The monitoring may be executed by probe inspection and/or detection, in-line, in flow stream, clamp on measurement or the like. Such monitoring may be more or less continuous and will catch tracer signal whenever they occur. In embodiments of the invention the monitoring is performed by analysing withdrawn fluid samples. This requires an embodiment with tracer release at a planned time or an automated sampling device because manually sampling is quite resource demanding.

The modification of the signal duration (flush-out duration) can be done in the following way: The increase of the delay chamber volume increases the duration of the travel time of the tracers through the delay chamber and thus the duration of the tracer flush-out. The increase of volume can be achieved either by increasing the length of the delay chamber (L) or the cross-section area(S). The relation between the flush out time and the delay chamber length can be approximately described as follows:

$$t \sim L/V$$

where L is the delay chamber length and V is the average velocity of the fluid in the delay chamber. The relation between fluid velocity in the delay chamber and in the flow restriction is as follows: $V*S=Vr*Sr$ where S is the cross-sectional area of the delay chamber, Vr is the velocity of the flow in the flow restriction unit/units, Sr is the effective cross-sectional area of the flow restriction unit/units. Thus, the increasing the cross-sectional area of the delay chamber will give a longer flush-out time.

In addition to modification of the delay chamber, the increase of the tracer travel time in the delay chamber can be achieved by modifying the flow restrictor units. Increasing the resistance of the flow restrictor unit to the fluid flow through it results in situation that lower fluid velocity inside the delay chamber corresponds to the pressure difference between inlet and outlet ports, thus the travel time and the flush-out time is longer for the modified flow restrictor unit. The flow rate in the delay chamber is used to calculate the pressure difference between the inflow and outflow ports, and the latter is used to calculate the flow rate in the base pipe using known empirical correlations for the pressure drop vs. fluid flow rate.

The exact relations between the pressure drop and the flow rate may not be required for such calculations. In the case when several of such shunt chambers (12*a*, 12*b*, 12*c*, 12*d* (as shown in FIG. 1) are installed along the well, the production rate for each location can be derived from the relative comparison of the flush-out times for all location and the known total production rate of the well.

A pressure drop between the inlet and outlet may be estimated based on the predefined chamber volume.

FIG. 2A shows a longitudinal sectional view of one of a shunt chambers of FIG. 1. The shunt chamber 100 is arranged in an annulus space 114 about the circumference of the base pipe 116. The shunt chamber 100 has a shunt flow passage 118 having inlets 120 and outlets 122. FIG. 2B shows that the shunt chamber has a plurality of inlets where mixed fluids 19 enter the shunt chamber from the base pipe 116.

FIG. 2C shows an end view of the separation section and shows the separated oil 21 and water 23 in the shunt chamber. FIGS. 2D and 2E is sectional views showing the narrow 29 tube flow restrictors 126*a* and 126*b*. The surrounding "annulus space" 127 now being blank pipe or sealed area at least in the inlet and outlet ends preventing shunt chamber flow to enter this area but led into the flow restrictors 126*a* and 126*b*.

Figures 3A, 3B, 3C, 3D, 3E:
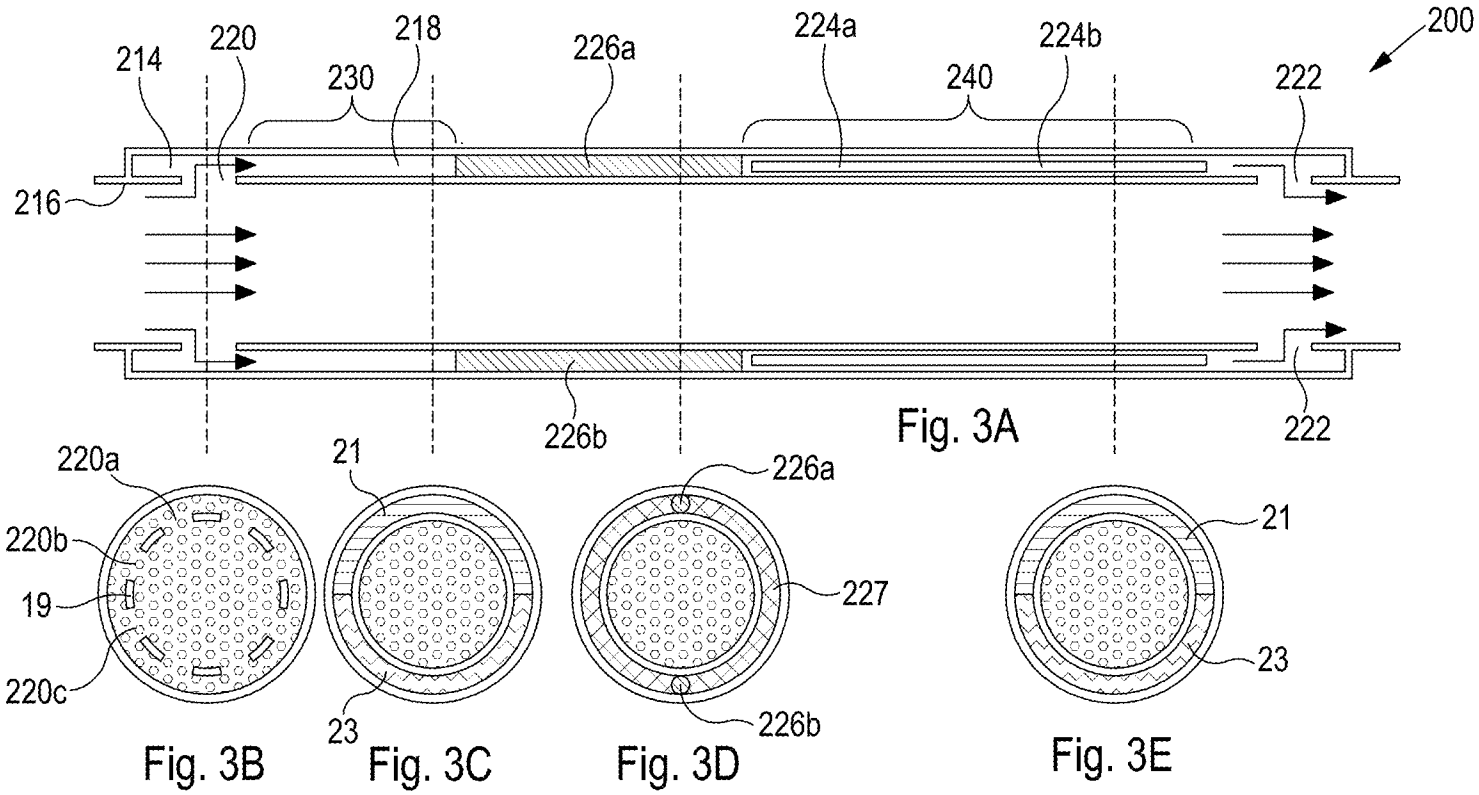
FIG. 3A is a longitudinal sectional illustration of the shunt chamber according to another embodiment of the invention where flow restrictors are placed upstream the delay chamber.
FIGS. 3B to 3E are sectional views along cut-lines A-A, B-B, C-C and D-D respectively of FIG. 3A.

FIG. 3A shows an alternative shunt chamber arrangement. The shunt chamber 200 is similar to the shunt chamber 100 described in FIG. 2A and will be understood from the description of FIG. 2A. However, the flow restrictors 226*a* and 226*b* are placed upstream of the delay chamber 240. The delay chamber 240 comprises tracer sources 224 which are fluid specific i.e. for water 224*a* or oil 224*b*.

FIGS. 3B to 3E are sectional views along cut-lines A-A, B-B, C-C and D-D respectively of FIG. 3A. FIG. 3B shows that the shunt chamber has a plurality of inlets where mixed fluids 19 enter the shunt chamber from the base pipe 216. FIG. 2C shows an end view of the separation section 230 and shows the separated oil 21 and water 23 in the shunt chamber. FIG. 3D is a sectional view showing the narrow tube flow restrictors 226*a* and 226*b*. FIG. 3E shows that the separate phases having passed through the respective restrictors contact the tracer 224.

Figures 4A, 4B, 4C, 4D, 4E:
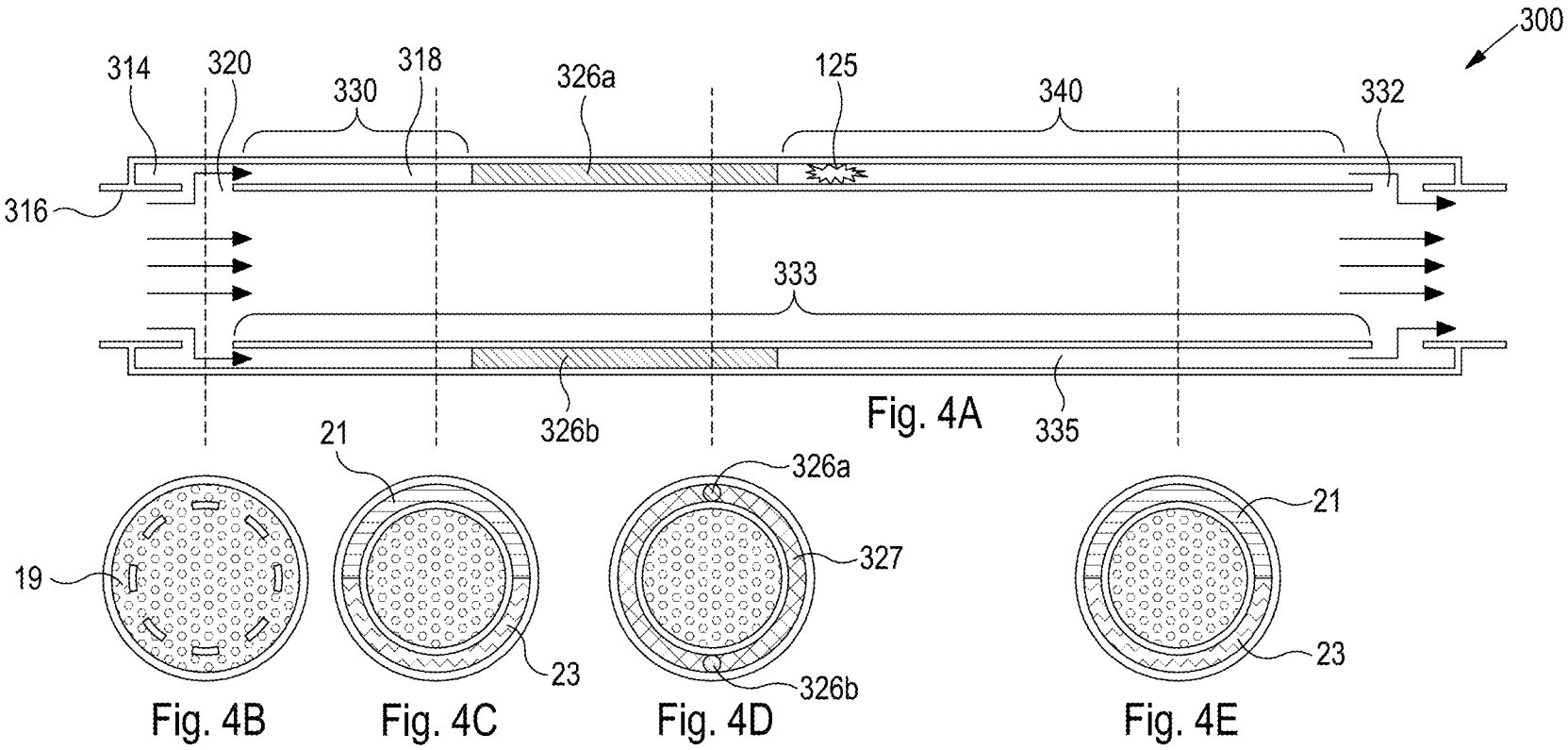
FIG. 4A is a longitudinal sectional illustration of a shunt chamber according to a further embodiment of the invention in which tracer are released at a known location inside the delay chamber at a predefined time or after command or any other predefined event downhole.
FIGS. 4B to 4E are sectional views along cut-lines A-A, B-B, C-C and D-D respectively of FIG. 4A.

FIG. 4A shows an alternative shunt chamber arrangement. The shunt chamber 300 is similar to the shunt chambers 100 and 200 described in FIGS. 2A and 3A and will be understood from the description of FIGS. 2A and 3A. However, the tracer source is only released at a known location 125 inside the delay chamber 340 at a predefined time or after command or any other predefined event downhole.

FIGS. 4B to 4E are sectional views along cut-lines A-A, B-B, C-C and D-D respectively of FIG. 4A. FIGS. 4B to 4E are similar to the sectional view of shunt chambers 200 described in FIG. 3A and will be understood from the description of FIG. 3A.

Figures 5A, 5B, 5C, 5D, 5E:
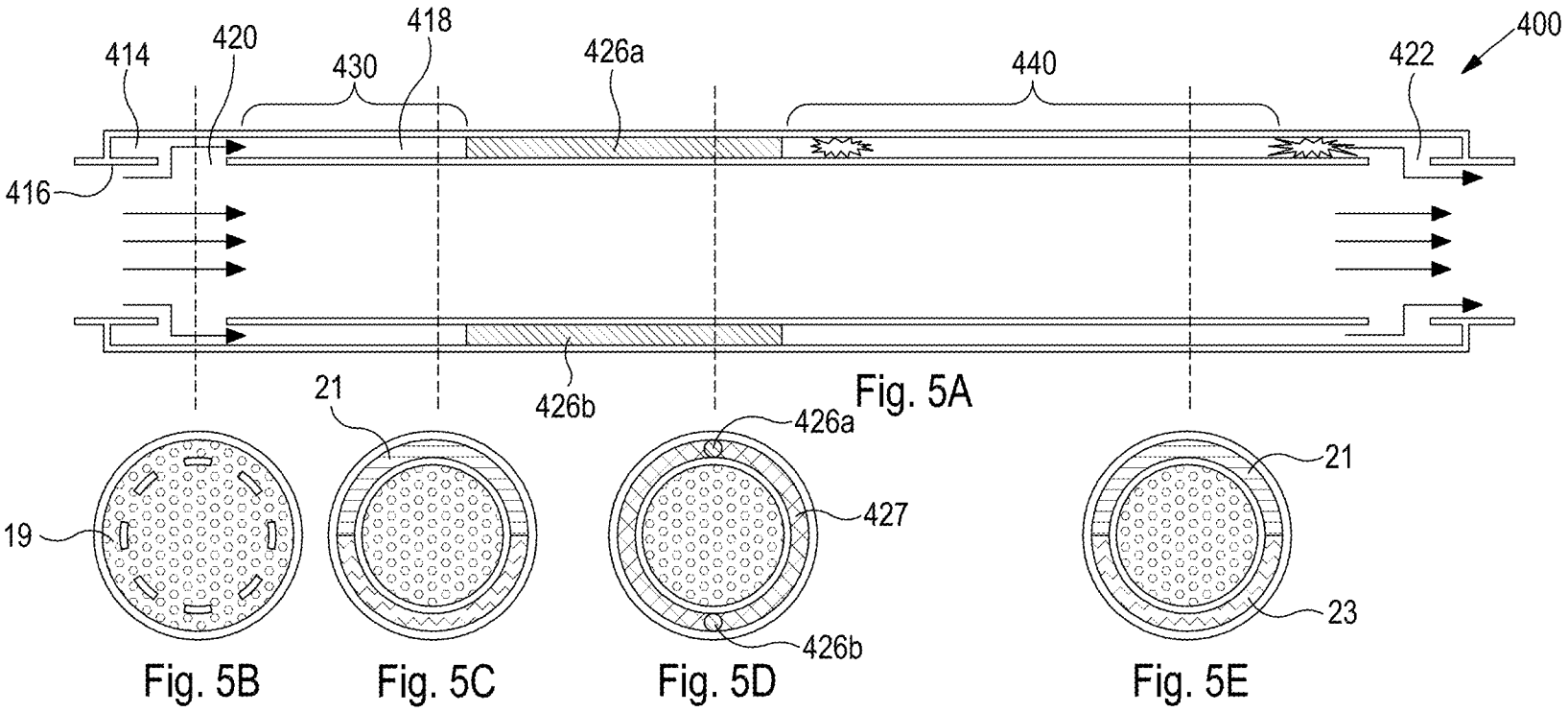
FIG. 5A is a longitudinal sectional illustration according to a further embodiment of the invention in which tracer are released at the start and at the end of the delay chamber to create two detectable spikes at detection point.
FIGS. 5B to 5E are sectional views along cut-lines A-A, B-B, C-C and D-D respectively of FIG. 4A.

FIG. 5A shows an alternative shunt chamber arrangement. The shunt chamber 400 is similar to the shunt chambers 100, 200, 300 described in FIGS. 2A, 3A and 4A and will be understood from the description of FIGS. 2A, 3A and 4A. However, the tracer source 424*a*, 424*b* is released at the two different ends of the delay chamber 440 to create two detectable spikes at detection point.

FIGS. 5B to 5E are sectional views along cut-lines A-A, B-B, C-C and D-D respectively of FIG. 5A they are similar to the sectional view of shunt chambers 200 described in FIG. 3A and will be understood from the description of FIG. 3A.

Figure 6:
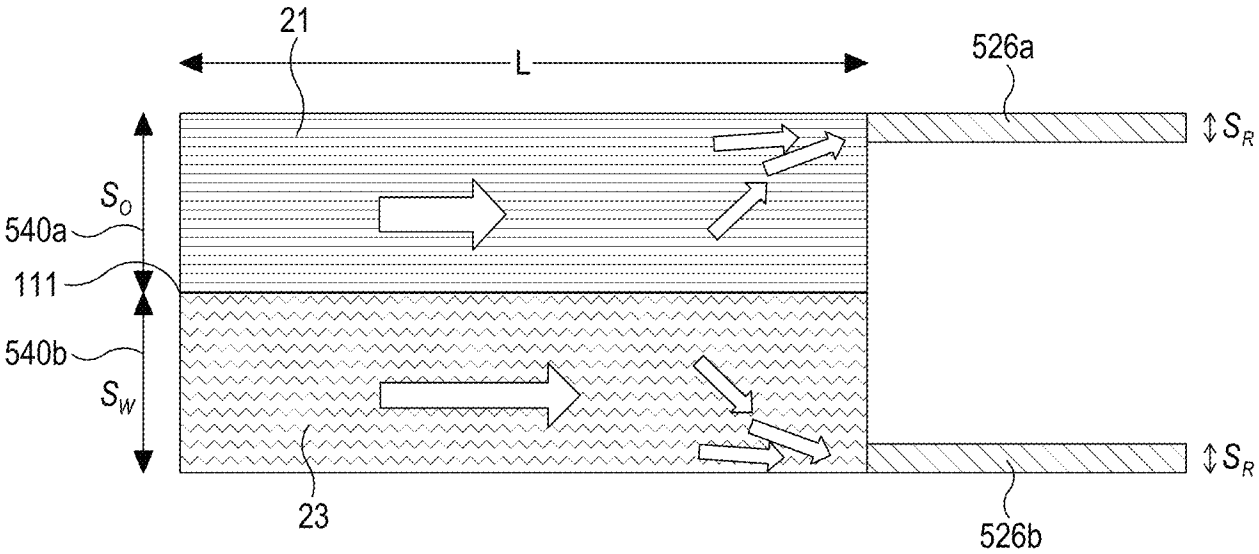
FIG. 6 is an illustration of the invention functionality and shows a portion of a delay chamber and upper and lower restrictor unit.

FIG. 6 shows an enlarged view of a portion of shunt chamber 500 showing a portion of a delay chamber 540 and upper and lower restrictor units 526*a* and 526*b*.

The functionality of the invention for the two-phase flow is first described for the simplest case when the well is horizontal in the location of the shunt chamber installation and the flow in the base pipe is segregated. In this case part of the delay chamber is filled with a first phase i.e. oil 21 and part of the delay chamber is filled with a second phase i.e. water 23. The location of the interface of the two phases 21 and 23 in the shunt chamber will be controlled only by the static pressure in vertical direction and will be levelled with the location of interface in the base pipe. As result, the delay chamber flow will be split into two delay chambers portions 540*a* and 540*b* as shown in FIG. 6.

The flush-out of each phase can be regarded as the flush out from an independent delay chamber. The effect of the interfacial forces at the interface of the two phases can be neglected because the surface of interface is only a small fraction of the phases surface and the main resistance is due to the wall friction and the resistance in the flow restrictors 526*a* and 526*b*.

The pressure difference between inlet and outlet creates the fluid flow in the shunt chamber. If the main pressure drop happens across the restrictor 526*a* and 526*b* and not in the delay chamber 540, the velocity of the flow through the restrictor is proportional to the pressure difference driving the flow ($\Delta P_B$). In the case of turbulent flow through the restrictor it is as follows (for the laminar flow, there is a linear dependence of the velocity from the pressure drop but conceptional functionality is the same):

$$V_{oR} \sim \left(\frac{\Delta P_B}{\rho_o}\right)^{0.5}$$

$$V_{wR} \sim \left(\frac{\Delta P_B}{\rho_w}\right)^{0.5}$$

Where $\Delta P_B$ is the pressure difference between the inlet and outlet ports in the production tubing or base pipe, or shunt chamber if the well fluids are flowing in the shunt before entering the main well flow stream; $\rho_o$ and $\rho_w$ are densities of oil and water, respectively.

The flush-out time of the oil tracer is proportional to the area occupied by oil in the shunt chamber:

$$t_o \sim \frac{L \cdot S_o}{V_{oR} \cdot S_R}$$

Where L is the length of the delay chamber, $S_o$ is the cross-section area of the delay chamber occupied by the oil phase, and $S_R$ is the cross-section of the flow restriction.

$$t_o = k_o(\rho_o, \mu_o) \cdot \frac{S_o}{\Delta P_B^{0.5}} \quad (*)$$

where $k_o(\rho_o, \mu_o)$ is the coefficient of proportionality, which depends on the fluid properties and the geometry of the shunt chamber. This coefficient is different for oil and water phase as it is a function of fluid density and viscosity.

Exact coefficients to relate flush-out time with the flow velocity, and hold-up can be obtained either by testing in the flow loop and/or use of empirical correlations or numerically for known fluid properties.

The flush-out time of water can be written in a similar manner:

$$t_w = k_w(\rho_w, \mu_w) \cdot \frac{S_{total} - {}_{10}S_o}{\Delta P_{B11}^{0.5}} \quad (**)$$

Where relation between the area occupied by water is the difference between total shunt chamber cross-section ($S_{total}$) and the area occupied by oil.

Flush-out time of oil (to) and water (tw) is measured topside, and thus, using equations (*) and (**) the two unknowns, the oil-hold up in the shunt chamber (So) and the pressure drop in the base pipe can be calculated.

The oil hold-up in the base pipe can be calculated from oil hold-up in the shunt chamber from the geometrical considerations. The pressure difference between inlet and outlet ports and the hold-up can be used to calculate the flow rate of the oil and water in the base pipe.

It is important to note that the area of the flow restriction should be constant and should not change due to hold-up, otherwise required monitoring will be impossible.

Dispersed Flow in the Base Pipe

In the case of mixed/dispersed flow in the base pipe situation is more complicated but principally is the same. Fluids after entering the delay chamber, in this realization annulus chamber, rapidly segregate as the fluid velocity in the annulus chamber is much smaller than in the bases pipe. See example from the laboratory tests in FIG. 7.

Figure 7:
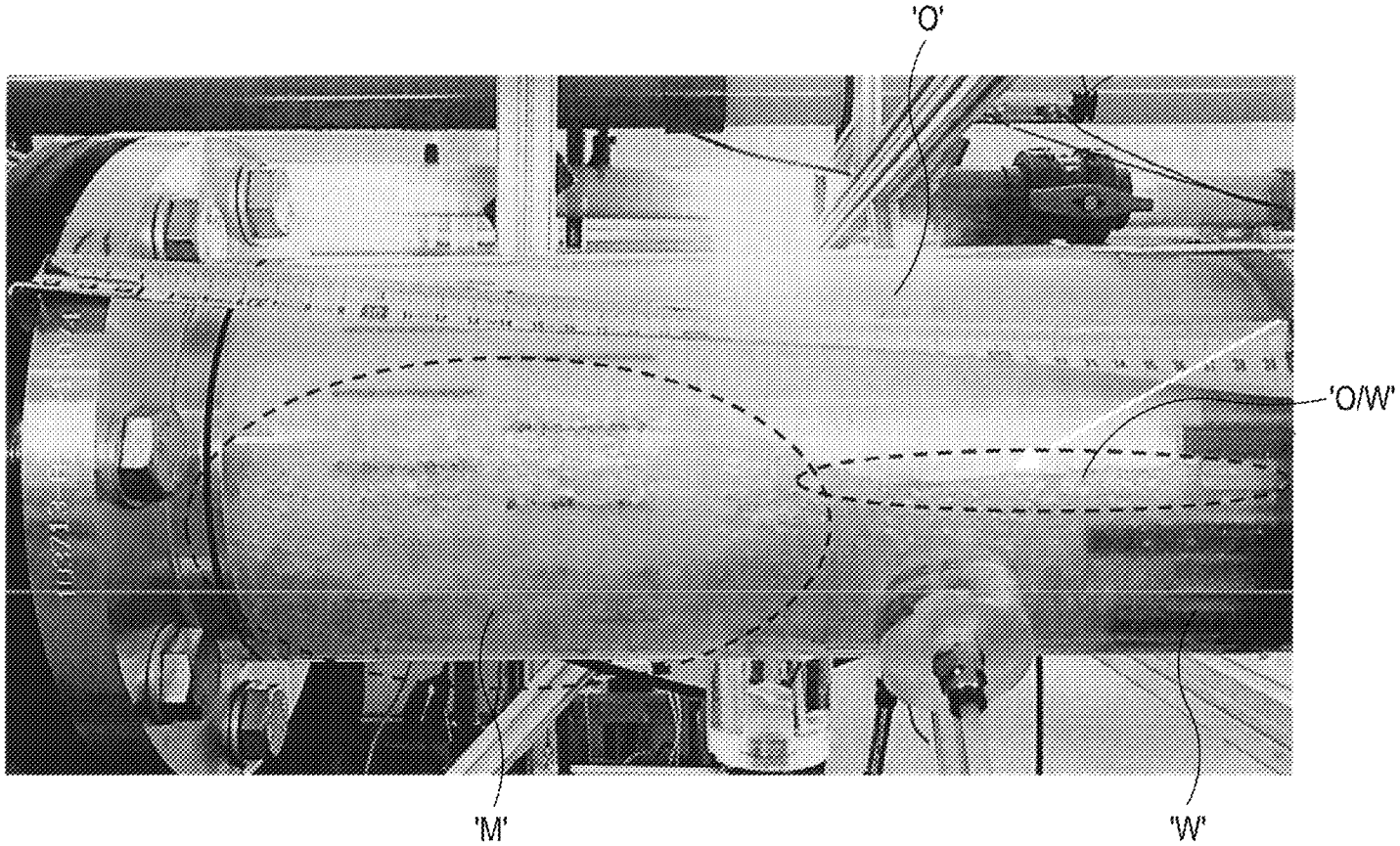
FIG. 7 is an image of a test pipe section illustrating a base pipe mixture entering a shunt chamber according to an embodiment of the invention and separating into two separate phases.

FIG. 7 is an image of a test pipe section illustrating a base pipe mixture entering a shunt chamber and separating into two separate phases. The base pipe flow rate is 350 ltr/min oil and 150 ltr/min water, the diameter of the base pipe is 100 mm and the flow is fully dispersed. The image in FIG. 7 indicates the short flow path until separation of the fluids along the measuring tape. Dispersed flow is shown at point "M". Pure oil phase is illustrated at point "O" and pure water at point "W". The interface between the two phases can be seen at point "O/W. The distance over which phases segregate is small and in this laboratory test it was around 5 cm. Thus there is very little dispersion in the delay chamber and its presence can be neglected. As was observed in the flow loop tests, there is a correlation between the hold-up in the annulus chamber and the hold-up of phases in the mixture. However, the relationship between the hold-up in the annulus chamber and the hold-up of phases is more complicated for the case of segregated flow.

For the case of the dispersed flow, the volume balance (which is the same as mass balance for incompressible fluids which corresponds to the considered case) of each fluid in the shunt chamber is as follows:

$$Q_i\alpha_o - Q_{Bo} = S_R V_o \sim \left(\frac{\Delta P_B}{\rho_o}\right)^{0.5}$$

$$Q_i(1-\alpha_o) - Q_{Bw} = S_R V_w \sim \left(\frac{\Delta P_B}{\rho_w}\right)^{0.5}$$

Where $Q_i$ is the total inflow of mixture from the base pipe into the annulus chamber, $\alpha_o$ is the volume fraction of oil in the base pipe mixture, $Q_{Bo}$ is the flow of the segregated (pure) oil phase back into the base pipe through inflow ports, $Q_{Bw}$ is the flow of the segregated (pure) water phase back into the base pipe through inlet ports.

As one can see from the equation above, the hold-up in the annulus cannot be readily obtained from the given equations, the inflow of the mixture and the outflow of each phase is mainly defined by the pressure drop in the base pipe. However, the back-flow of the segregated oil and water phase are dependent on the pressure distribution in the base pipe and the annulus (shunt chamber).

Figure 8:
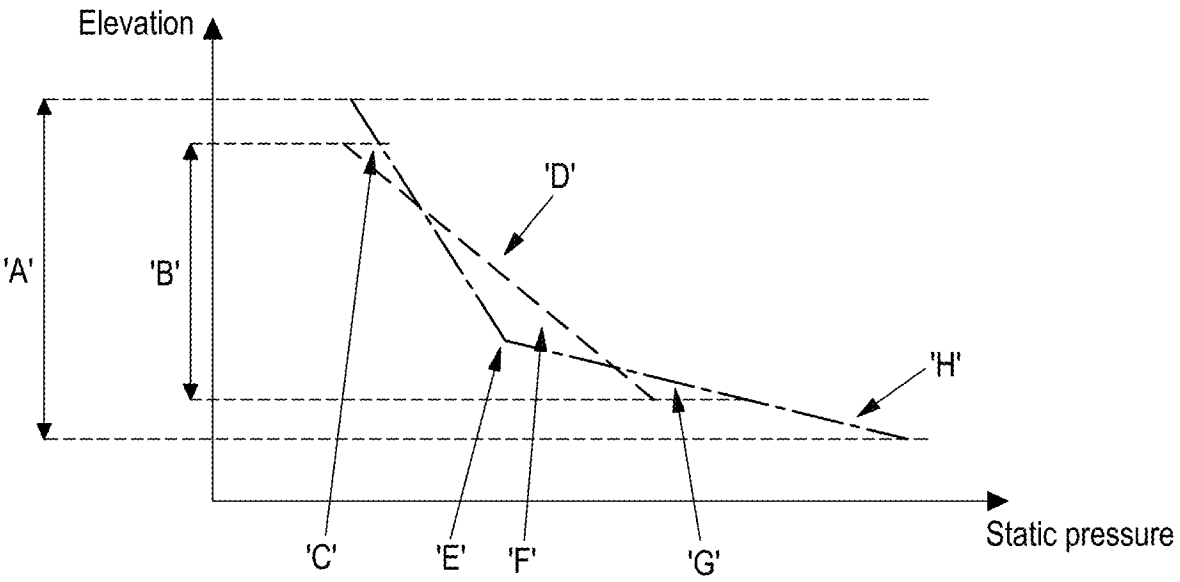
FIG. 8 is a graphical illustration of the pressure distribution in the base pipe and annulus.

The static pressure in turn is directly related to the hold-up of the fluids and typical static pressure distribution is illustrated in FIG. 8.

FIG. 8 is a graphical illustration of the pressure distribution in the base pipe and annulus near the inlet ports. The exact inclinations of the curves are dependent on the flow rate in the base pipe and on the hold-up of different fluids.

Arrows "A" represents the annulus outer diameter. Arrows "B" represents the base pipe diameter. Arrow "C" indicates the point where oil exits the annulus. Arrow "D" indicates the pressure of the mixture in base pipe. Arrow "E" shows the interface position in the annulus.

Arrow "F" shows the point where the base pipe mixture entering the annulus.

Arrow "G" shows the point where water exits the annulus. Arrow "H" shows the pressure in the annulus.

When the static pressure in the annulus chamber is higher than the pressure in the base pipe, the fluid would flow into the base pipe and vice versa. Therefore, in the case of mixture the picture is relatively complex. In the case of partially mixed phases or thick dispersion layer between two segregated phases flowing in the base pipe, analysis is rather similar to the case of fully dispersed mixture in the base pipe.

Equations and illustration given above and in FIGS. 7 and 8 only show the direction of analysis and were presented to explain the basic physics. To obtain accurate flow rates of each phase a combination of experimental, analytical, and/or numerical modelling of the process should be utilized. As was shown above, the fraction of the segregated phases can move back into the base pipe through inlet ports, and it can be considered by numerical modelling. The hold-up in the annulus chamber (shunt chamber) occupied by each phase are not only related to the volume fraction of entered fluids, but can be dependent on the total flow rate in the base pipe, inclination of the pipe and the physical properties of the fluids such as viscosity, density, and interfacial tension between two phases.

The one or more local multiphase production flows (F1, F2, F3, shown in FIG. 1) is the sum of annulus spaced flow through the delay chamber and the inside base pipe volume when the shunt chamber is inward vented, but flow through the shunt chamber will be negligible compared to the base pipe flow in order to get fluids to separate. There will be a significant lower flow velocity in the shunt chamber.

The shunt chamber tracer may be arranged as a section of a production tube which means it will be installed as a part of the completion. One may have a completion with several more flow shunt chambers arranged along in this manner along a base pipe in a completion from toe to heel in a producing well.

In an embodiment of the invention the shunt chamber and/or tracer release arrangements is arranged for retrofit installation which means that one may use a retrofit installation tool such as a hang off tool or a patch tool. The shunt chamber will then have a diameter fitting inside the pipe, tube etc where installed and pressure drop etc must be taken into account when calculating the production parameters according to the invention.

Flow Paths

FIGS. 2 to 5 show embodiments of the invention where the inlet ports (114, 214, 314, 414) are arranged open to the flow inside the production tube. An embodiment the shunt chamber arrangement according to the invention has the inlet ports are arranged open to both the flow outside the production tube and to the flow inside the production tube.

After the shunt flow has entered the shunt chamber the flow should be allowed to separate. Common to all embodiments is that the flows must be separated before entering the flow restrictors, that is, after entering the inlet ports the shunt flow separates into the low density flow phase (hydrocarbon and the high density flow phase (generally water phase) (or gas and oil phase respectively) in a flow phase separation section before entering the delay chamber (140,240,340, 440) or flow restrictors (126*a*, 126*b*, 226*a*, 226*b*, 326*a*, 326*b*, 426*a*, 426*b*). The flow restrictors may be arranged before or after the delay chamber (140, 240, 340, 440).

Tracer (124*a*, 124*b*, 224*a*, 224*b*, 324*a*, 324*b*, 424*a*, 424*b*) can be introduced into the separated flow or before separation, it will not affect functionality of the system as the separation happens quickly and over the negligible time compared to the travel time in the delay chamber. Tracers can be introduced by a slow release from polymer matrix due to diffusion, or dissolution, or degradation of matrix, or by mechanical release.

In an advantageous embodiment the shunt chamber has a cylindrical body (100*a*, 200*a*, 300*a*, 400*a*) for co-axial arrangement to a base pipe, production tubing, casing in said well. This is as a portion of, enveloping or arranged outside or inside said production tubing. Then the shunt chamber is surrounding the pipe and uses a separation section and further separately measure of water and oil flow.

A neutral tracer may be used for both phases as they may be read out in the concentration measurement based on for instance the concentration profile, signal duration and knowledge of the restrictor for each separated phase.

A separate measure of the phases is a prerequisite for solving the sets of equations above.

Figure 14:
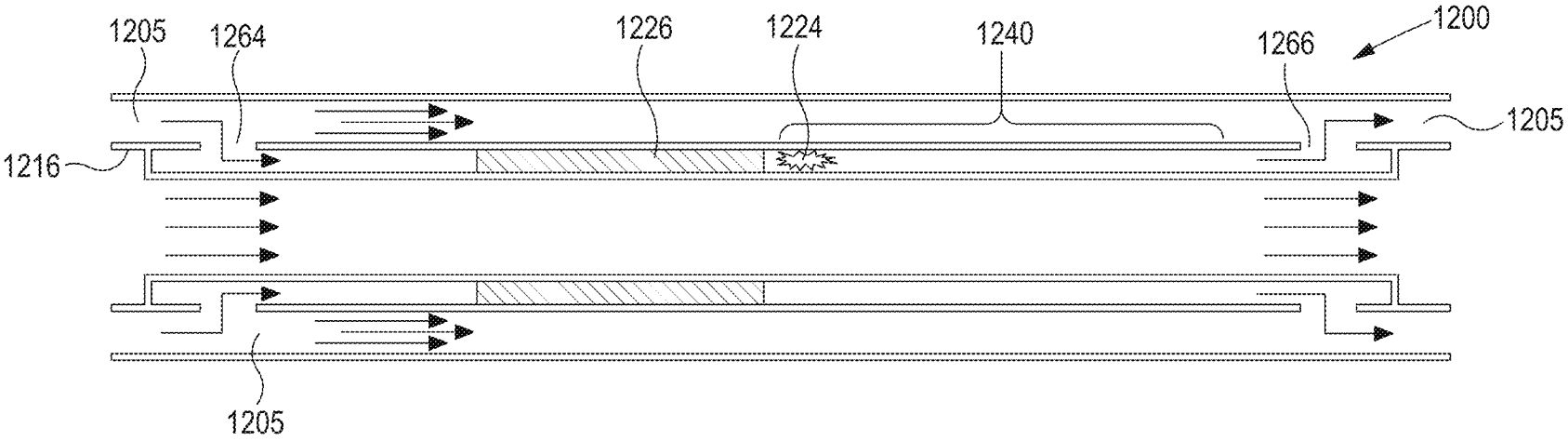
FIG. 14 is a longitudinal sectional sketch of a shunt chamber according to a further embodiment of the invention.

According to an embodiment of the invention as shown in FIG. 14 the shunt chamber has inlet ports 1264 arranged open to the flow outside the production tube, to the annulus 1205, gravel pack etc. The outlet ports 1266 may also be arranged open to the flow outside the tube, the base pipe or the casing as shown in FIG. 14. The shunt flow is then taken from the annulus space outside the base pipe, tube or the like, separated, marked by tracers, and flow restricted before returning back to the annulus space. The pressure driving the flow through the shunt chamber is the annulus delta pressure between inlet and outlet. This may allow analysis on the influx zones from the formation or just on the annulus flow as is. In this example oil and/or water is released into the delay chamber 1240 at a predefined time or after a command.

Positioning of the Flow Restrictors

The key requirement for the flow restrictors is that they function as expected and are positioned correctly, i.e., that there is one flow restrictor for each phase. In addition, the flow restrictor for the high-density phase i.e. water should be located at the bottom of the shunt chamber and the flow restrictor for the low-density phase i.e. oil at the top of the shunt chamber, such that the monitoring can be performed even at low hold-ups of one of the phases. Similarly, shunt chambers can be designed for oil and gas mixture.

Practically, the orientation of the shunt chamber downhole is unknown and cannot be adjusted on demand, therefore, there are several ways how to overcome such challenge which are described below.

A Heavy Rotating Disk or a Section of the Pipe

According to an embodiment of the invention, before the portion of the local flow enters the shunt chamber at least the restrictor units (126*a*, 126*b*, 226*a*, 226*b*, 326*a*, 326*b*, 426*a*, 426*b*) are aligned according to the low density phase and high density phase to be separated in the shunt chamber.

Figure 9A:
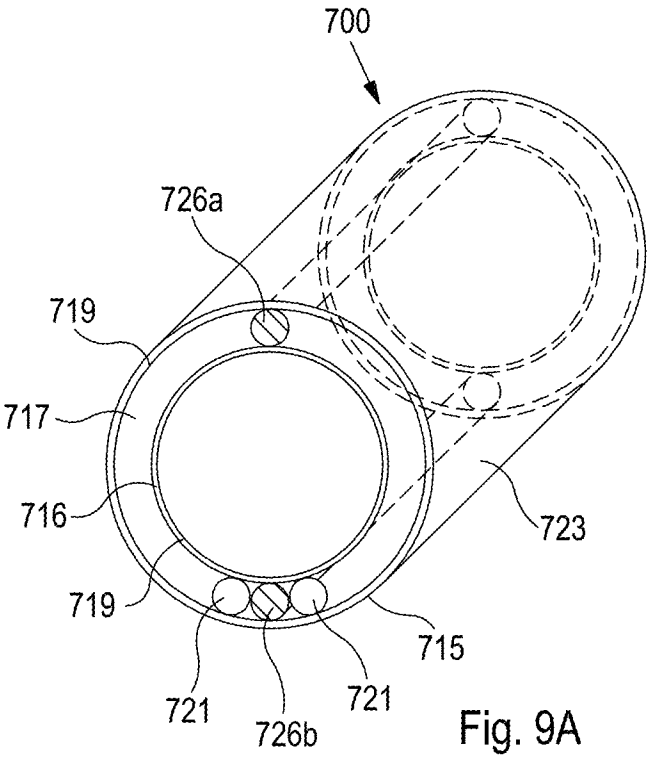
FIG. 9A shows a perspective views of a flow restriction arrangement in a shunt chamber according to an embodiment of the invention.
Figure 9B:
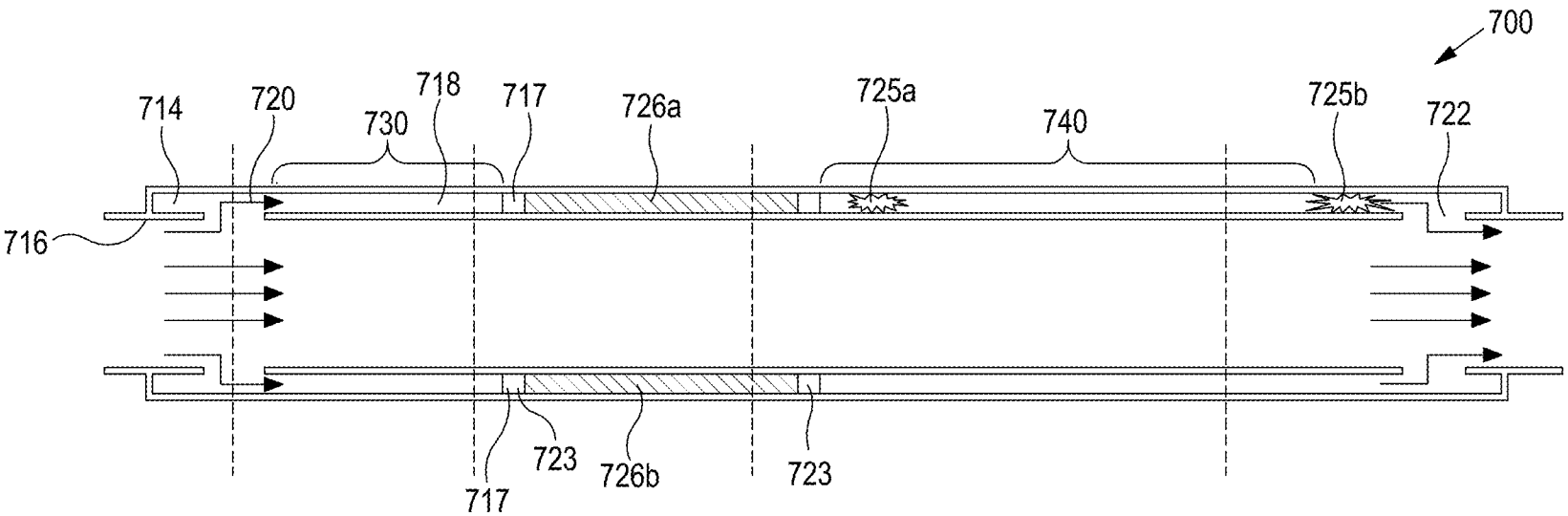
FIGS. 9B and 9C show longitudinal sectional sketch of further flow restriction arrangements in shunt chambers according to embodiments of the invention.

FIGS. 9A and 9B shows a flow restriction arrangement of a shunt chamber according to an embodiment of the invention. The arrangement has a fixed outer pipe 715 and fixed base pipe 716. Located between the outer pipe 715 and base pipe 716 is a ring insert 717 which is mounted on bearings 719 and is moveable relative to the outer pipe 715 and base pipe 716.

The alignment arrangement has an upper flow restrictor 726*a* for low density phase and lower flow restrictor 726*b* for high density phase mounted on a rotating ring insert 717. The rotating ring insert 717 is gravity controlled.

In this example the flow restrictors are a rotating ring insert. However, the flow restrictors may be a pipe like insert which can freely move/rotate, independent of pipe or tube section wherein the shunt chamber is installed. Free movement of flow restrictors may be achieved by installed bearings 719 between the insert and the fixed parts of the shunt chamber. The center of mass of the insert 717 is decentralized to the edge of it by means of weights or plumbs 721 or the like. The insert 717 will take the position in which the weights or plumbs are at the bottom as best shown in FIG. 9A.

To avoid unnecessary rotation during drilling, the space 723 between the base pipe and the rotating insert 717 can be filled with non-newtonian fluid which would not react on the quick movements but would yield to the slow movements.

FIG. 9B illustrates another embodiment on how to orient flow restrictors by having a rotational insert comprising the flow restrictors in the middle of, lengthwise orientated, two fixed sections of the shunt chamber. The shunt chamber has inlet ports 720, outlet ports 722, separation chamber 730, flow restrictors 726*a*, 726*b* and delay chamber 740. Bearings 723 may be arranged between the rotational insert 717 and the fixed portions i.e. the separation chamber and the delay chamber.

Figure 9C:
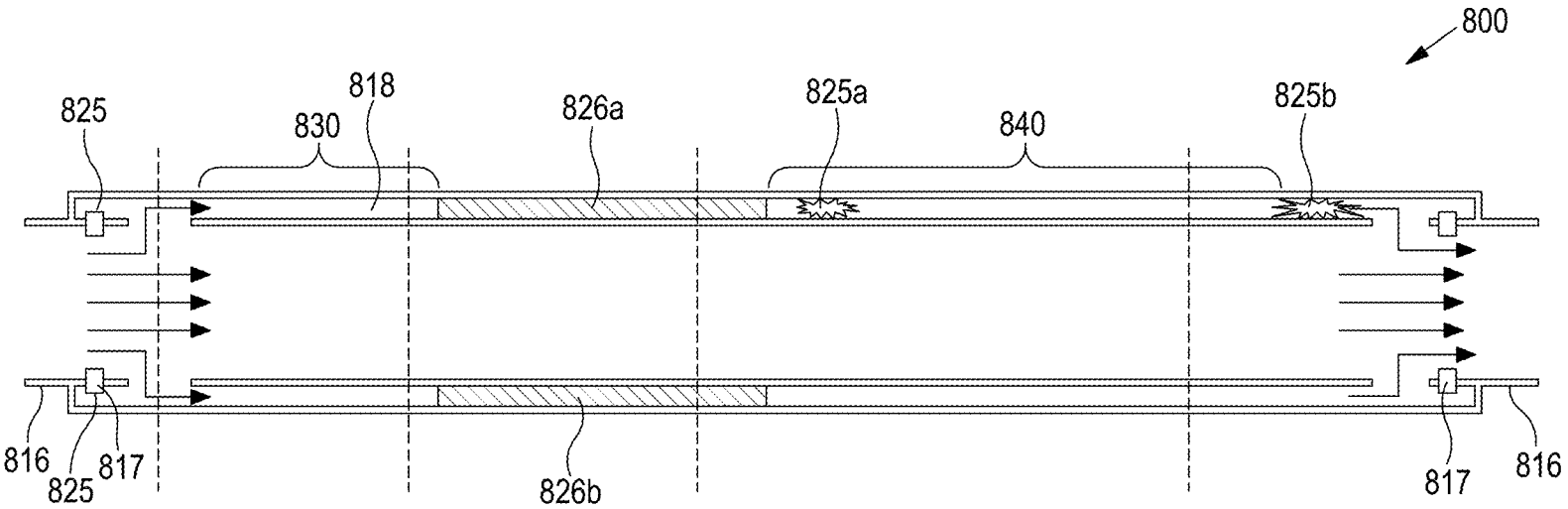

FIG. 9C shows an alternative shunt chamber arrangement 800 and illustrates another embodiment on how to orient flow restrictors by having a rotating section of piping with shunt chamber. The shunt chamber has movable section 817 with bearings 823 around the circumference of the pipe located between the shunt chamber and the base pipe which allows the shunt chamber to rotate relative to the fixed base pipe 816.

FIGS. 9B and 9C show simultaneous release of oil and/or water tracers near the start 725*a*, 825*a* and end 725*b*, 825*b* of the delay chamber.

Several Pluggable Channels

Figure 10:
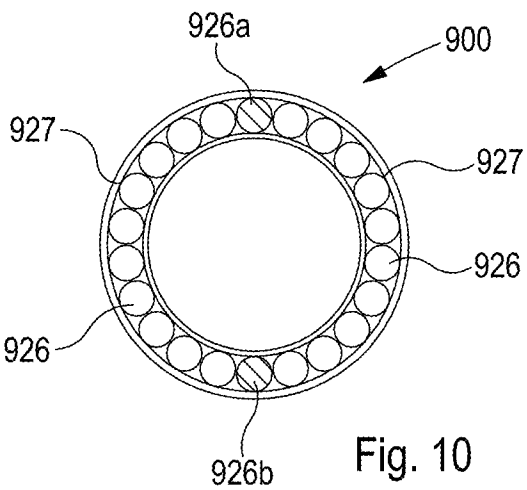
FIG. 10 shows a cross section of a shunt chamber according to an embodiment of the invention with several flow restrictors.

FIG. 10 shows an end view of a shunt chamber 900 in which several channels with flow restrictors 926 are arranged around the circumference of the shunt chamber. When the shunt chamber is installed downhole all the channels with flow restrictors will be plugged with plugs 927 except one which has the highest position 926*a* and one which has the lowest position 926*b* in the carrier. Such design allows to avoid a movable component, however, requires installation of several flow restrictors.

Plugging of the flow restrictors can be done using electrical mechanical system which would identify positions of the carrier and plug required restrictors. The system may open restrictors if in the initial state all of them plugged. Several ways of implementation exist, including gyros, accelerometers or using spring systems which would balance and keep the restrictors open only if they are in upper or lower locations.

In an embodiment of the invention the shunt chamber may be arranged with a plurality of flow restrictors that are arranged in the circumference of a portion of said shunt chamber wherein said flow restrictors further are arranged with plugging means and a trigger (gyro or the like) for alignment and activate said plugging means for keeping the highest positioned restrictor and one which has the lowest position in the carrier to act as said flow restrictors.

To avoid blocking of the flow restrictors in the partially open position due to presence of particles or fouling. The entrance to the flow restrictors can be made out of rubber which would be pressed by the control mechanism closing it. In this case, there will be no unwanted open channels.

The quantitative downhole multi-phase flow (F) surveillance method according to the invention comprises, before a portion of the local flow enters the shunt chamber, triggering an opening of a sealing device of the inlet and outlet ports (if they are initially locked).

Flow Restrictor Design

The flow restrictors may be elongated tubes. In an embodiment the flow restrictor may be a flow port or a flow channel or passage of a porous media. The simplest way to create a flow restrictor is to use a narrow tube which would create substantial pressure drop through it due to the wall friction.

In an embodiment the flow restrictors are constituted by the use of nozzles. However, the nozzles can get plugged by the fines present in the well fluids. Installation of filter to protect nozzles may create addition resistance to the flow in the multi-phase environment due to interfacial forces.

The restriction efficiency (property) of the low-density phase flow restrictors may differ from the high-density phase flow restrictors restriction efficiency (property). This means that the behaviour of each phase inside the shunt chamber is known and the velocity will be proportional to the differential pressure from inlet to outlet of the shunt chamber inside the tube, base pipe, i.e. in the production flow. The differential pressure is what drives the separated flows through the shunt chamber. The amount of each separated phase inside the chamber and the design of the restrictor will set the duration of the tracer trace at the monitoring point, seen as a concentration value. One may get a long-lasting tracer trace, signal.

Tracer Deployment

In an embodiment of the invention the tracer release system is a dissolvable or diffusion-based polymer matrix system for slow release of a dose of the tracer.

Tracers can be installed inside the polymer matrix or degradable container inside the well from which tracers would be slowly released. In previous examples it is has been described that the well is shut in to build a tracer cloud. However in the following the embodiments the at least one shunt chamber is shut in to build a high concentration tracer cloud that when released produces a high amplitude detectable spike signal.

In an embodiment of the invention controllable valves may be located at or in the shunt chamber to control the flow of fluid into or out from the shunt chamber in response to a signal from surface, a change in velocity of production fluid and/or a pressure differential between the shunt chamber and the production pipe.

Figure 16A:
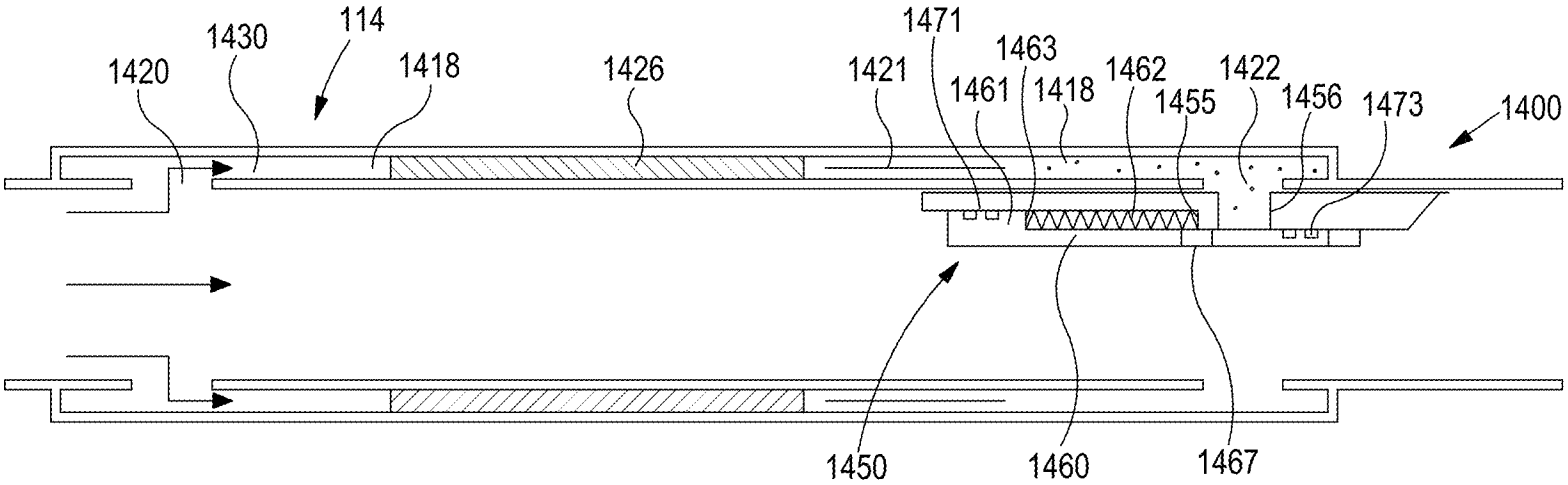
FIGS. 16A and 16B are schematic diagrams of shunt chamber comprising of a velocity pressure valve assembly in accordance with an aspect of the invention.
Figure 16B:
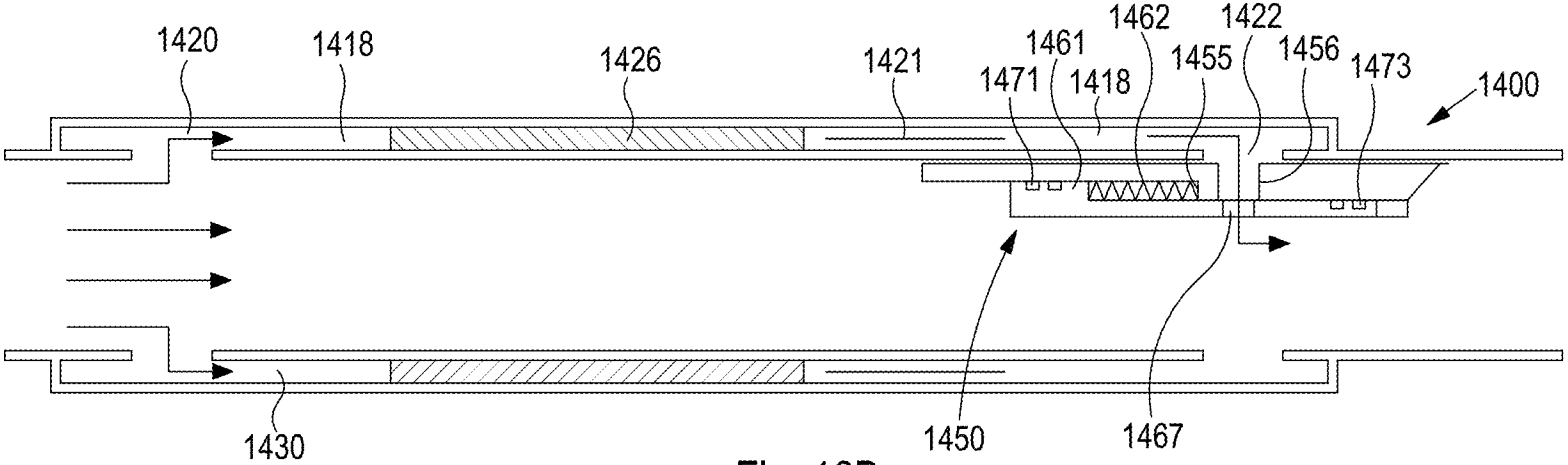

FIGS. 16A and 16B shows an embodiment of the invention where a shunt chamber 1400 is arranged in an annulus space 114 having a velocity valve located at the outlet of the shunt chamber 1400. For clarity a velocity valve arrangement is shown for only one outlet.

The shunt chamber 1400 has a shunt flow passage 1418 having inlets 1420, flow restrictor 1426 and outlets 1422. Arrows in FIGS. 16A and 16B denote the direction of fluid travel. The shunt chamber 1400 has a shunt flow passage 1418 which comprises a phase separation section 1430. The shunt chamber comprises flow restrictors 1426*a* and 1426*b* and a delay chamber 1440 which comprises a tracer material 1421. The tracer material is disposed in the delay chamber to allow fluid to contact the tracer material and pass around the tracer material 1421 in the delay chamber. The tracer material 1421 is designed to release tracer molecules when exposed to a target well fluid i.e. oil, gas or water.

FIGS. 16A and 16B show a velocity valve assembly 1450 located at the outlet 1422 of shunt chamber 1400. The velocity valve assembly is located in the inner diameter of the production tubing. The velocity valve has an actuating sleeve 1460 which is biased in FIG. 16A to a closed position by a sleeve biasing mechanism in this case a compression spring 1462 is located between a shoulder 1463 on the valve body 1455 and shoulder 1461 on the sleeve 1460.

The valve body 1455 has a port 1456 through the wall of the valve body which is aligned with the outlet 1422 of the shunt chamber. The sleeve 1460 supported by the valve body with 12 seals 1471 and 1473 at each end. The sleeve is axially moveable relative to the valve body. The sleeve 1460 has a sleeve port 1467. The sleeve is moveable from a closed position where the sleeve port 1467 is not aligned with port 1456 and outlet 1422 as shown in FIG. 16A, to an open position where the sleeve port 1467 is aligned with port 1456 and outlet 1422 as shown in FIG. 16B.

In a closed valve arrangement shown in FIG. 16A the spring 1462 is a spring biased in a fully closed position in a low production flow. Fluid in the shunt flow passage 1418 and delay chamber 1440 is prevented from exiting the shunt chamber by the actuating sleeve 1460 covering the outlet 1422. The tracer material 1421 remains exposed to a volume of fluid over the period of time that the valve assembly is closed building up a high concentration of the tracer particles in the fluid volume. Depending on the tracer type, its release rate into the target fluid and the period of time the valve assembly is closed determines the enrichment level of the fixed fluid volume with tracer.

After the shut in, to release the built up high tracer concentration a choke assembly connected to the production tubing is operated to increase the production flow rate above the pre-set threshold for the valve.

In response to a higher production flow rate, the flow force acting on the sleeve 1460 is sufficient to compress the spring 1462 moving the sleeve 1460 to a fully open position where the sleeve port 1467 is aligned with port 1456 and outlet 1422 as shown in FIG. 16B The high concentration of the tracer also known as a tracer cloud is released from the shunt chamber and carried to the surface where is detected as a high amplitude tracer response.

The pressures on acting on the sleeve can be adjusted by reducing or increasing pressure in the production tubing by controlling a choke connected to the production tubing.

In this example the spring in a compression spring. However, it will appreciate that a tension spring may be used. Although in this example the sleeve biasing mechanism is a spring it will be appreciated that other biasing mechanisms may be used such as a pressure chamber containing a gas such as nitrogen. The sleeve biasing mechanism spring may be adjustable which may be adjustable for example in the case of a spring by changing the type, length or tension of the spring.

Figure 17A:
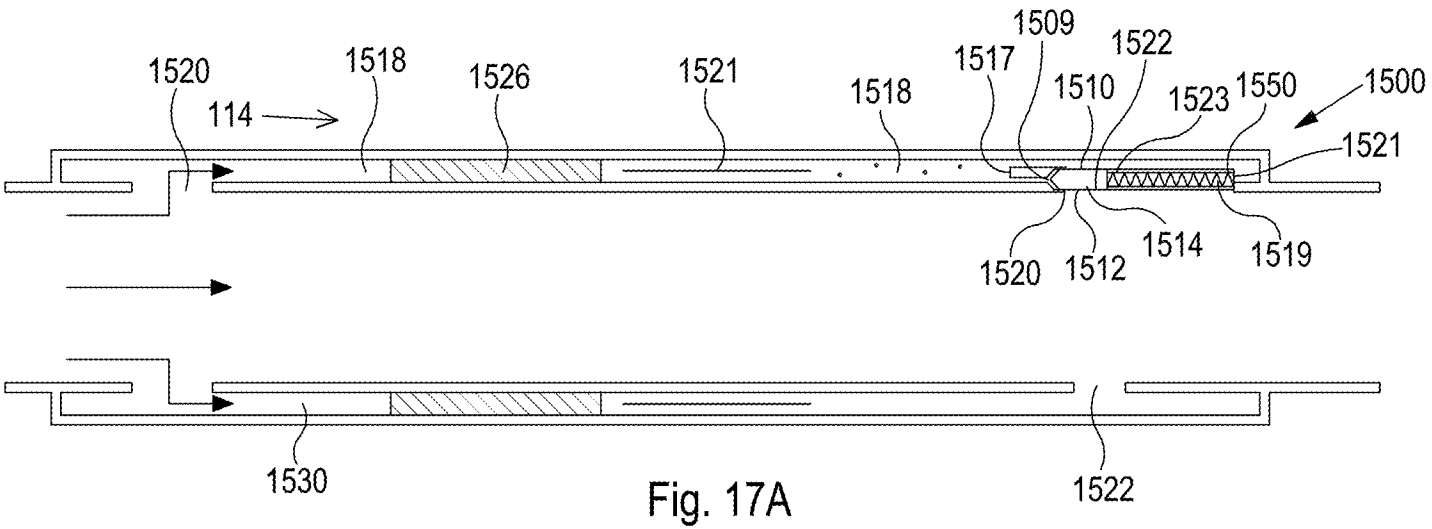
FIGS. 17A and 17B are schematic diagrams of shunt chamber comprising of a differential pressure valve assembly in accordance with an aspect of the invention.
Figure 17B:
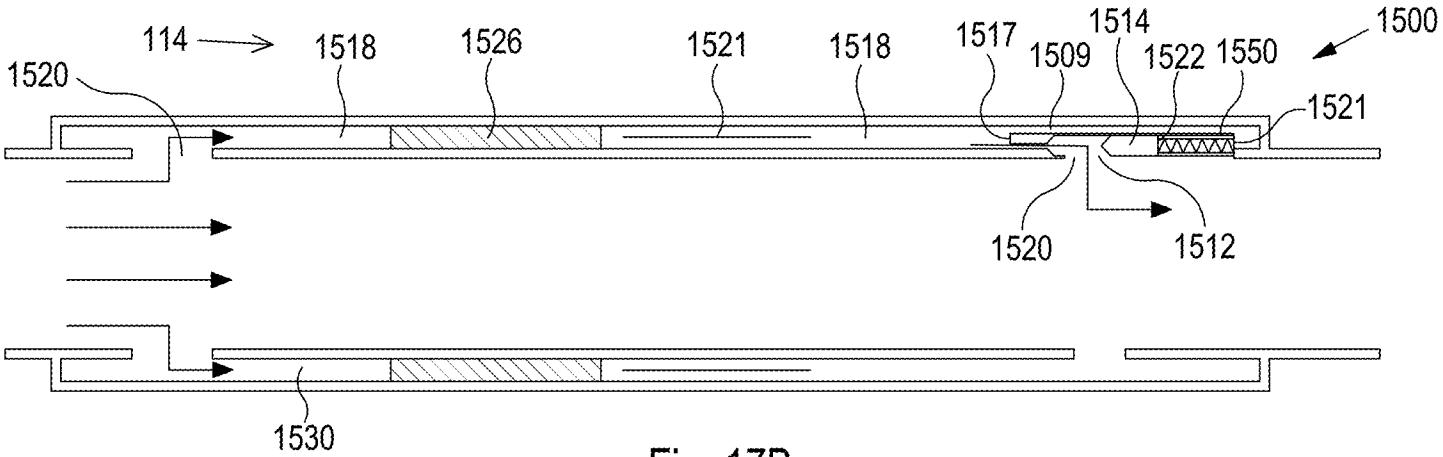

FIGS. 17A and 17B shows a longitudinal sectional view of a shunt chamber 1500 arranged in an annulus space 114 according to an embodiment of the invention where a differential pressure valve is located at the outlet 1522 of the shunt chamber 1500.

The shunt chamber 1500 has a shunt flow passage 1518 having inlets 1520, phase separation chamber 1530, flow restrictors 1526 and outlets 1520. Arrows in FIGS. 17A and 17B denote the direction of fluid travel.

The shunt chamber 1500 has a delay chamber 1540 which comprises a tracer material 1521. The tracer material is disposed in the delay chamber to allow fluid to contact the tracer material and pass around the tracer material 1521 in the passage. The tracer material 1521 is designed to release tracer molecules when exposed to a target well fluid i.e. oil, gas or water.

FIGS. 17A and 17B show a differential pressure valve assembly 1550 located at the outlet of shunt chamber 1500. The differential pressure valve assembly is located in the inner diameter of the production tubing.

The valve assembly 1550 is located within the shunter chamber to avoid restriction of the inner diameter of the production tubing. However, it will be appreciated that it may be arranged within the shunt chamber. The other components of the apparatus have been removed for clarity.

The valve assembly 1550 has a valve body 1510 having an outlet port 1512 through the wall of the valve body which is aligned with the outlet 1520 of the shunt chamber. A sleeve 1514 is axially moveable relative to the valve body. The valve body 1510 has an inlet port 1517 in fluid communication with a valve seat 1519. In a valve closed position the sleeve is located in the valve seat 1509 and the sleeve covers outlet port 1512 and outlet 1520 as shown in FIG. 17A. In a valve open condition, the sleeve is moved axially away from the valve seat and the outlet port 1512 and outlet 1520 are in fluid communication with the inner volume within the shunt chamber as shown in FIG. 17B. A sleeve biasing mechanism, in this case a spring 1519 is located between shoulder 1521 on the valve body and shoulder 1523 on the sleeve.

In this example the sleeve biasing mechanism is a spring 1521 it will be appreciated that other biasing mechanisms may be used such as a pressure chamber containing a gas such as nitrogen.

The sleeve 1514 acts as a piston which is axially movable by differential in pressure between the shunt chamber and the production tubing. Pressure from within the shunt chamber is applied to sleeve 1514 via inlet port 1517. Pressure from the production tubing is applied to sleeve 1514 via outlet port 1512 and outlet 1520. When a pressure applied to inlet port 1517 reaches a predetermined amount the pressure force compresses spring 1514 to axially move the sleeve away from valve seat 1509 such that the sleeve uncovers outlet port 1512 and outlet 1520.

The sleeve will remain in the open position as shown in FIG. 17B as long as the differential pressure between the flow shunt chamber apparatus and the production tubing is sufficient to keep the spring 1514 compressed.

Once the pressure differential between the flow shunt chamber apparatus and the production tubing is reduced below a predetermined amount the force of the spring can overcome the pressure force acting on the sleeve. The sleeve is moved to a closed position where the sleeve is in the valve seat 1509.

The pressures on acting on the sleeve can be adjusted by reducing or increasing pressure in the production tubing by controlling a choke connected to the production tubing.

In this example the spring in a compression spring. However, it will appreciate that a tension spring may be used.

In the above embodiments only one outlet valves is described for the shunt chamber. However, it will be appreciated that the outlets for each phase or outlets for each subchamber in the shunt chamber may have a valve.

In the above embodiments the valves are located at the outlet and are configured to selectively open and close the outlet based on the local fluid velocity in the base pipe and/or a differential pressure between the base pipe and the shunt chamber. However, valves may alternatively or additional be located at the inlet and may be configured to selectively open and close the inlet based on the local fluid velocity in the base pipe and/or a differential pressure between the base pipe and the shunt chamber.

The valves described in FIGS. 16A, 16B, 17A and 17B may be closed for a period of time to shut in the shunt chamber to increase the concentration of tracer molecules in the shunt chamber. By shutting in the shunt chamber, the concentration of tracer molecules released from the tracer material into the target fluid increases until the volume of fluid in the shunt chamber becomes enriched with tracer molecules.

Although the above examples describe the control and actuation of the at least one valve by differential pressure or changes in flow velocity, additional or alternatively the at least one valve may be electrically controlled and actuated. The at least one electrical valve may be controlled remotely by wired and/or wireless communication.

After the shunt chamber is shut in and the tracer concentration in the shunt chamber has increased to build a tracer cloud the valve may be opened to release the tracer cloud by adjust production flow and/or creating a pressure differential between the fluid in the shunt chamber and the production flow.

The high concentration of the tracer or tracer cloud is released as required into the production pipe and is carried to the surface and detected as high amplitude spike signals.

The valve may be closed to shut in the shunt chamber. The shunt chamber may be shut in for a period of time. The period of time may range from hours to months. The shunt chamber may be shut in for a period of time required to create a sufficiently high or increased local concentration of tracer also known as a tracer cloud which is detectable at surface when released from the shunt chamber. The shunt chamber may be shut in for less than 24 hours to shut in the shunt chamber. The valve may be closed for more than 24 hours to shut in the shunt chamber.

The valves described above may be adjusted to change the rate of release of the tracer into the production pipe to adjust the amplitude and/or duration of the tracer response spike at the detection point.

The tracer release system may be controlled by downhole states or conditions such as pressure, temperature, flow velocity, conductivity, salinity, viscosity, etc. This may trigger the signal receiver or may by chemical or physical impact open a flow through of the shunt chamber and thus trigger the release system for releasing tracers.

When triggered the tracer releasing system may release tracer from a polymer matrix, tracer liquid or a solid releasing system which releases tracers from a matrix, The tracer may be released by injecting tracers by an injector or releasing the tracers from a container. Degradable tracers can be used or tracers' containers which would create bursts of tracers in the chamber. Such containers can be water soluble alloys and water and oil soluble polymers.

In an embodiment of the invention the tracer release system comprises a mechanism tracer release system for releasing of tracers. In an embodiment of the invention by controlling outlet or inlets valves from the shunt chamber controls the start of flow through the shunt chamber. A tracer cloud may be established inside the chamber by shutting in the shunt chamber.

The method may allow the tracer releasing system to release a first dose of at least one of the tracers to a first end of the delay chamber and second dose of at least one of the tracers to a second end of the delay chamber simultaneously. The tracer release system then has two injectors and injector positions each phase. This will result in a dual concentration peak for each phase of each shunt flow in the analysed fluid.

The tracer concentration of the produced tracer cloud should be 2 times the background concentration or higher, practically between 5 and 1000 times said background concentration.

Providing a shunt chamber which is capable of being shut in allows for the selective generation and release of high concentrations of tracer molecules without requiring the shutting in of the well. The shunt chamber may be configured to be shut in during production in the well. By providing a shunt chamber apparatus with at least one valve configured to selectively control the flow of fluid through the at least one outlet may allow the apparatus to be shut in to increase the concentration of tracer molecules in a fluid volume of the apparatus.

The subsequent opening of the valve to release the increased concentration of tracer may create a tracer transient. The increased concentration of tracer molecules propagates downstream with production flow as a tracer cloud, slug or shot which may be detectable downstream of the apparatus and/or topside as tracer response signal or spike at the downstream detection point.

A benefit of shutting in the shunt chamber is that accurate flow analysis may be conducted in a multiphase system as it captures a moment of time in the production flow and enables the different phases to contact their respective phase specific tracers improving the certainty of multiphase analysis.

Timed Mechanical Release

Figure 15A:
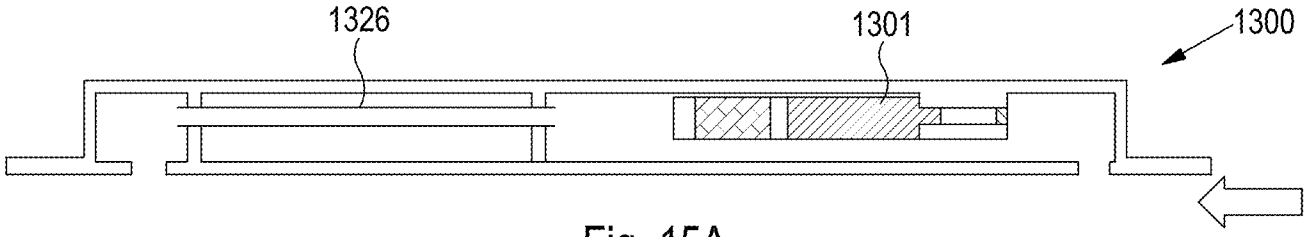
FIG. 15A shows a longitudinal sectional sketch of a shunt chamber comprising of a mechanical tracer release system according to an embodiment of the invention.
Figure 15B:
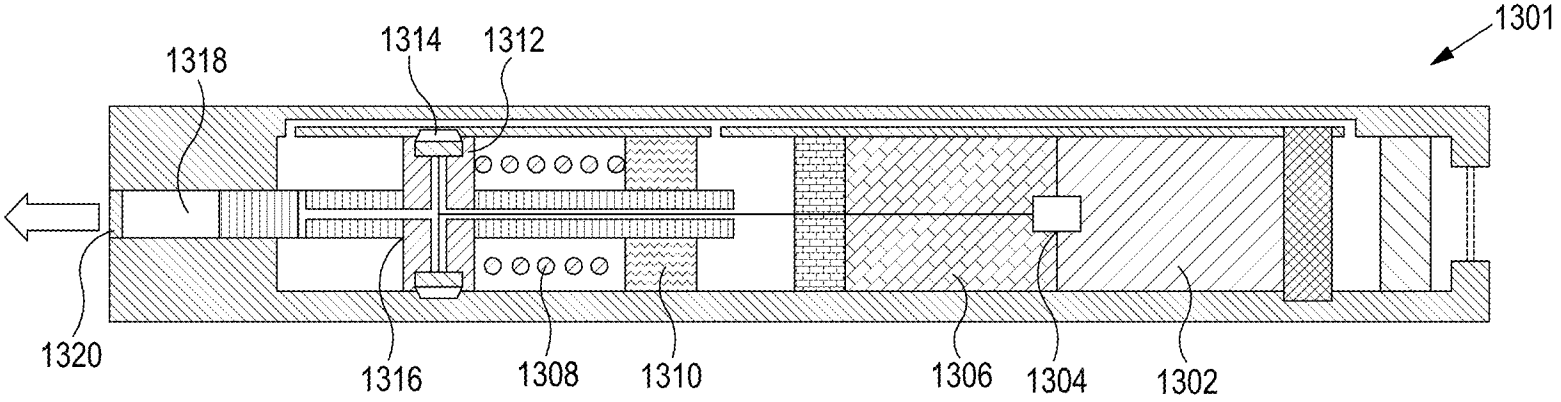
FIG. 15B shows an enlarge view of the mechanical tracer release system of FIG. 15A.

FIG. 15A shows a shunt chamber 1300 with a tracer release system 1301 comprising a mechanical release system for releasing a dose of the tracer. FIG. 15B is an enlarged view of the tracer release system 1301.

The tracer release system 1301 comprises a timer 1302, relay 1304, and battery 1306 to control the tracer release. The system also comprises a spring 1308, spring tension nut 1310, melt ring 1312, slips 1314, ejection piston 1316, compensated fluid chamber 1318 and burst disk 1320.

In the case when the tracers are released according to the timer it is not required for the timer to be very accurate. As long as, the tracer signal is captured at the detection point (D), the exact time of release is not important. In addition, the tracer introduction into the chamber does not need to be forceful or quick. For example, accuracy of measurements would be 30% if the time for tracers to dissolve, or reach target phase, or distribute takes 30% of the total travel time in the delay chamber. If the travel time is 20 min, it is acceptable that it takes 6 minutes for the tracers to reach target phase.

Figure 11:
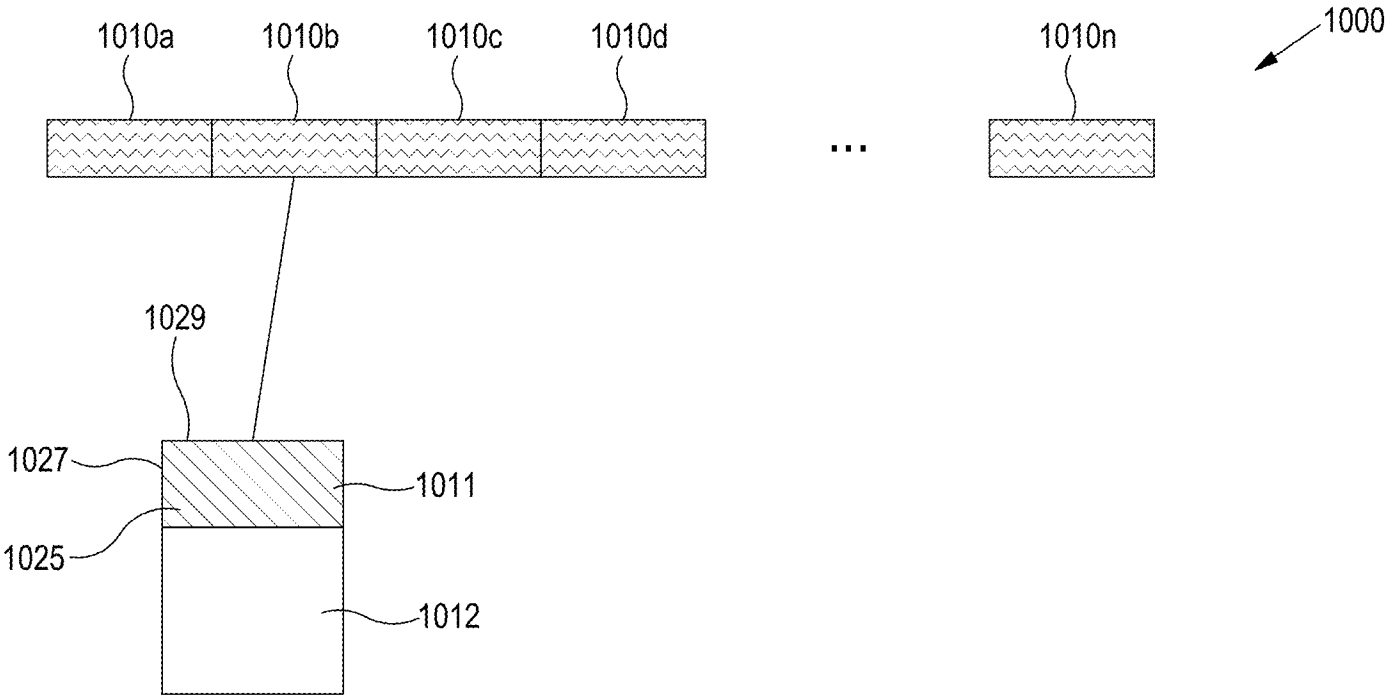
FIG. 11 illustrates a tracer release system for use in a shunt chamber according to an embodiment of the invention.

FIGS. 11A and 11B show a mechanical release system according to an embodiment of the invention. The mechanical release system 1000 consists of several release units 1010*a*, 1010*b*, 1010*c*, 1010*d* . . . 1010*n* connected to each other, this ensures for a rather accurate tracer release. The shunt chamber will then have a tracer release system 1000 having two or more serial connected release units each comprising a release controller (control mechanism) 1011 and a tracer chamber 1012 for the tracer 1024.

The release controller further comprising a signal sender mean 1025 for transmitting a signal to a signal receiver mean 1027 in consecutive release units for activating a tracer releasing delay mechanism 1029 in the consecutive release unit 1010*a*, 1010*b*, 1010*c*, 1010*d* . . . 1010*n* for releasing a dose of said tracer after a pre-set time. Each release unit 1010*a*, 1010*b*, 1010*c*, 1010*d* . . . 1010*n* comprises a tracer chamber 1012 and the release controller 111.

The release controller 1011 and delay mechanism 1029 may be a mechanical clock or the like i.e., based on harmonic oscillator and spring, in addition of a set of gear wheels to control the speed of energy release. The frequency of the harmonic oscillator can vary under effect of the downhole temperature, but as long as such effect can be estimated it is sufficient for measurements. Tracers can be released even an hour or a day later than planned, as long as the tracer signal is measured at the detection point. A tracer releasing delay mean can for different embodiments be a mechanical timer device, a dissolving wall actuated (signal sender) by the tracer release of pre-released tracer or an electronic timer.

When tracer is release by a first unit 1010*a*, the unit sends signal to the next unit 1010*b* to start its timer. Such mechanism can be implemented purely mechanical. The complete system of several units can provide monitoring for many years.

The merit of mechanical system is a simple design and no danger of batteries self-discharge at high well temperatures as in case of electronic timers. However, a similar implementation will in an embodiment be made with electronical timers as a delay mechanism. If liquid form of tracers are used, the tracers can be released by opening the tracer chamber or having a piston which would squeeze tracers into the delay chamber. Low energy spring can be used to push piston, for example. The exact release time of tracers will drift, however, expected arrival of tracer to detection point can be adjusted based on the time when previous signal was measured.

Tracers in a form of powder can be used for monitoring as well, as long as they reach the target phase under effect of gravity or buoyancy and would dissolve in the target phase directly without any intermediate solvent. Units can be placed along the delay chamber or in circumference, or in any other suitable way.

Instead of a timer, dissolvable plugs can be used between tracer chambers and work as a tracer releasing delay mean. The time of each plug dissolution would function as a timer between sequential tracer releases. However, such plug should open the tracer chamber completely so that there is no spreading of the tracer release over too long time. Electronical timers can also be used.

The mechanism controlling tracer release can be chemical reaction, dissolution of plugs, electrical or mechanical clocks. It is important that control mechanism of the next release system is activated only after previous release system.

The tracer release system release may be controlled by a downhole timer device. This may be pre-set or comprising a signal receiver.

The tracer release system release may be controlled by command from surface, the command being transmitted either wirelessly or by wire and connected to a signal receiver. Those systems may be combined both with chemical, physical and clock like systems. The shunt chamber tracer release arrangement according to an embodiment of the invention may have inlet and or outlet ports with a sliding sleeve port for opening and closing of the inlet ports. This may be used as a tracer release trigger or also as a start-up protection device preventing contaminant during installation and completion phase. The inlets and the outlets may have means for temporary locked openings for installation purpose.

The inlet ports may be opened for a shunt flow to enter the shunt chamber and closed to trigger a tracer release signal to form a tracer cloud by holding the ports closed for a pre-set time. The ports may subsequently be opened to drive the shunt flow through the shunt chamber by differential pressure. The ports may act on signal given from surface. The ports may also act as a result of physical or chemical changes downhole.

Simultaneous Injection of Tracers on Each End of the Delay Chamber

As an alternative to the creation of a flush-out signal, a different approach can be used. In this case the same tracers or different tracers are released simultaneously near the start of the delay chamber and near the end of the delay chamber as best shown in FIG. 4. The distance between release points should be known and the release of tracers should be either simultaneous or after known time interval. Each of the releases of tracers will create a detectable peak of tracer concentration at the detection point. The difference between the arrival time of those two peaks will then be used to calculate the fluid velocity in the delay chamber, and thus the hold-up and flow rates of the two phases flowing in the production tubing.

Design of the Carrier for Wells with High Production or Inclined Wells

Figure 12A:
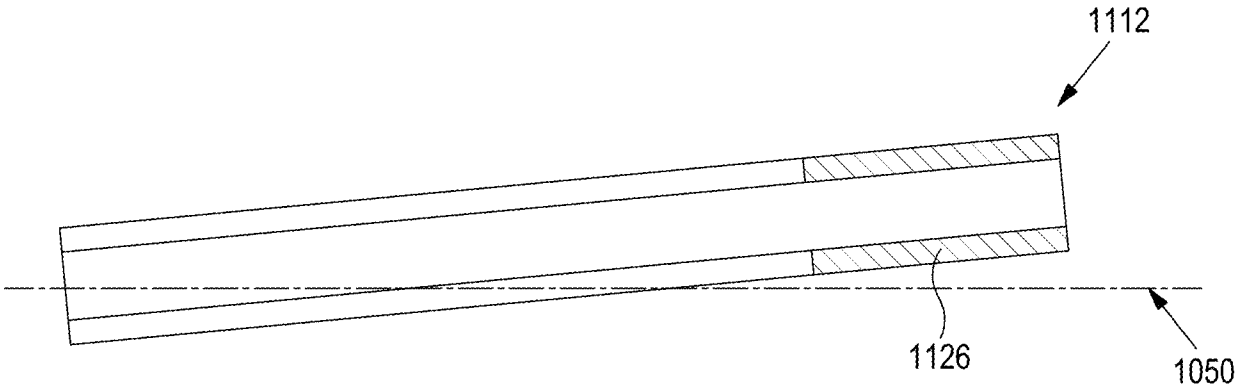
FIGS. 12A and 12B are longitudinal sectional illustrations of a shunt chamber according to an aspect of the invention shown in an inclined and generally horizontal well respectively.
Figure 12B:
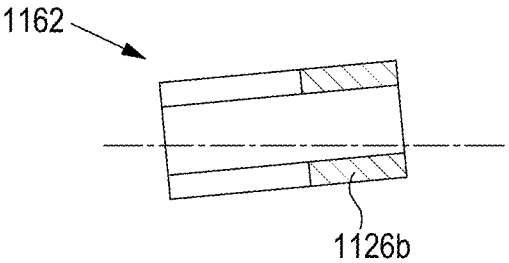

The technology cannot be applied for vertical wells or for the wells with any steep inclination, while the gravity is used to the fluid segregation. This technology can only be applied for horizontal wells and wells with small inclination, however even for the wells with small inclination application of shorter carrier should be considered due to the problem of. inclination of the well as shown in FIG. 12A and it shows the importance to consider carrier/shunt chamber design. As shown in FIG. 12A a long carrier/shunt chamber 1112 where 1150 is the oil-water interface. The long carrier/shunt chamber 1112 cannot provide required functionality because water does not reach the flow restrictors 1126 unless an advanced embodiment of the invention is used. FIG. 12B shows a short carrier/shunt chamber 1162 according to an embodiment of the invention where water can reach the flow restrictor 1126*b*.

Figure 13A:
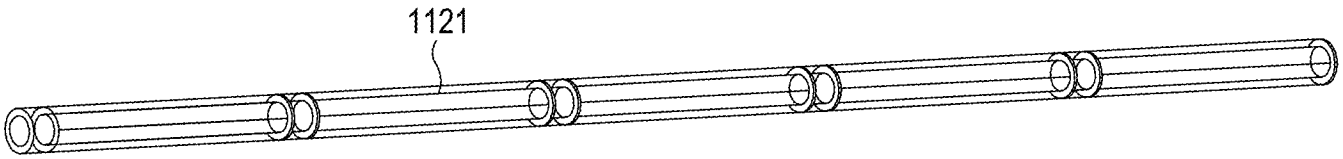
FIGS. 13A, 13B and 13C show perspective views of a shunt chamber according to an aspect of the invention.
Figure 13C:
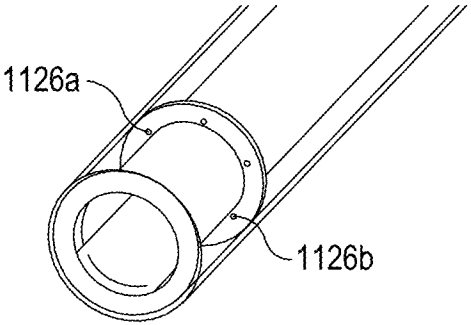
Figure 13B:
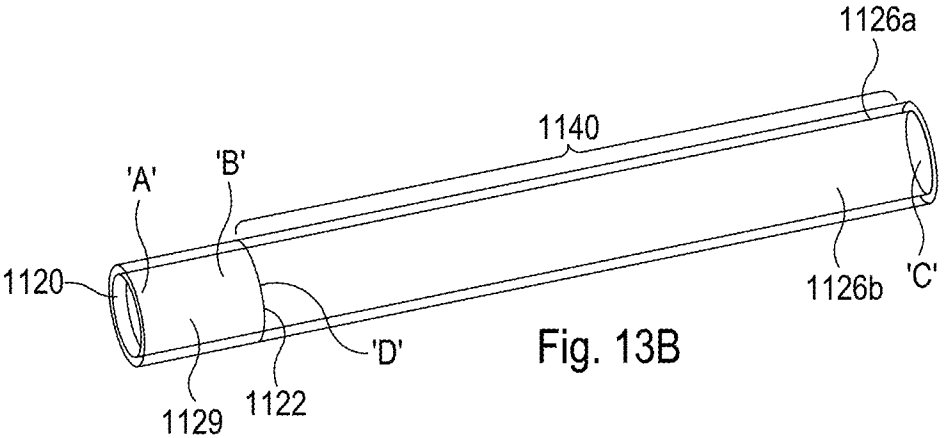

FIG. 13A shows a full carrier 1121. FIGS. 13B and 13C shows a shunt chamber in accordance with an embodiment of the invention. The delay chamber 1140 is placed downstream the flow restrictors 1126*a*, 1126*b*. The shunt chamber has a separation chamber which is space 1129 for the fluid to segregate before entering the flow resistors. The invention is adapted for inclined wells, the flow restrictors 1126*a*, 1126*b* and delay chamber 1140, related to the production flow (F) flow direction, extends further downstream of the one or more outlet ports 1122 but related to the shunt flow direction through the shunt chamber are arranged as downstream flow passages, please see FIG. 13.

FIGS. 12A and 12B shows how inclination of the well is important to consider in carrier design. With the shorter carrier there are two problems. One is the restriction on the amount of tracers which can be installed and as the result the life time of the system. However, it is easy to fix it by installing several short carriers which can accommodate the same amount of tracers as the long carrier.

The second problem is limited space for the flow restrictor and the delay chamber, plus if the flow rate is very high in the well it is hard to achieve required pressure drop through the flow restriction. In an embodiment of the invention, to overcome this challenge, inflow and outflow ports are located close to each other, and routes the fluid to go "forth and back" relative to the flow direction in the base pipe. It will reduce the pressure driving the fluid flow in the shunt chamber and thus the requirements for the shunt chamber volume (length) and the length of the flow restrictor units in the case if they are implemented as tubes. One of the possible embodiments is illustrated in FIG. 13. The fluid mixture enters the shunt chamber (location A in FIG. 13). Fluids separate due to segregation and enter flow restrictors (location B in FIG. 13) which are long narrow tubes installed inside the delay chamber and open to the delay chamber at location C in FIG. 13. Afterwards fluids move to location D in FIG. 13 where they exit back to the base pipe. The main advantage is that the length of delay chamber is longer than the distance between inflow 1120 and outflow 1122 ports.

The invention provides an interpretation method for quantitative multi-phase downhole surveillance for a petroleum well with a production flow in a well. This means having provided data from a producing well having at least one shunt chamber with separated flow phases through separate flow restrictors of known design;

one or more tracer injection positions;

having one or more local multiphase production flows;

the data comprises measurements of tracers, in the production flow at a detection point (D) downstream of the at least one shunt chamber to determine tracer concentration values for the one or more tracers; and calculating the characteristic flush-out time or travel time for the separated phases in the at least one shunt chamber based on tracer concentration values.

The method may comprise calculating the characteristic flush-out time or travel time for the separated phases in at least one delay chamber in the shunt chamber based on tracer concentration values.

Interpretation method embodiments may take advantage of production information data provided from the well. One or more of the following production data may be combined with the concentration data provided above including total production rate, separate water-, oil- and gas-production rates, down hole and/or top side pressure, choke settings and down hole and/or top side temperatures.

The interpretation does not need to be performed on site. Samples may be collected for analysis at a later time and/or at a different location. Interpretation may be conducted at a later time and/or at a different location to the sampling and/or analysis steps.

Figure 18A:
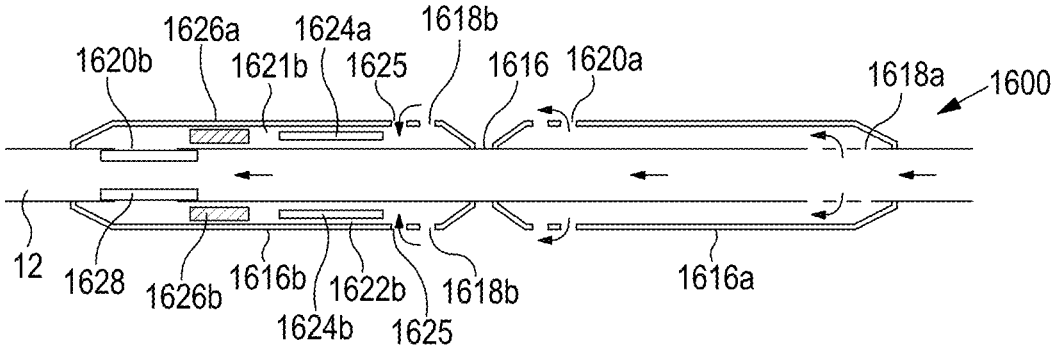
FIGS. 18A to 18C are schematic diagrams of shunt chamber comprising an outward venting section and in accordance with an aspect of the invention.
Figure 18B:
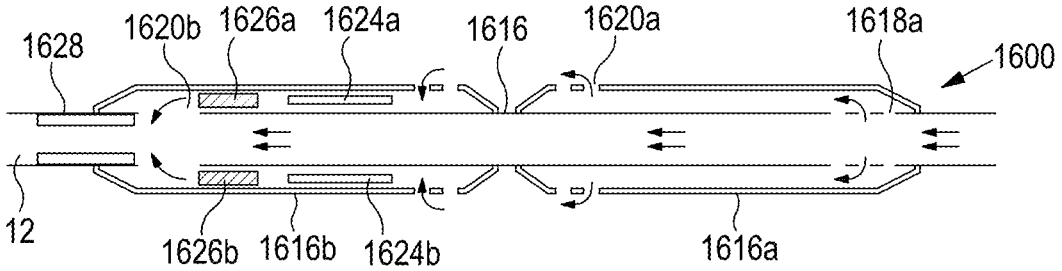
Figure 18C:
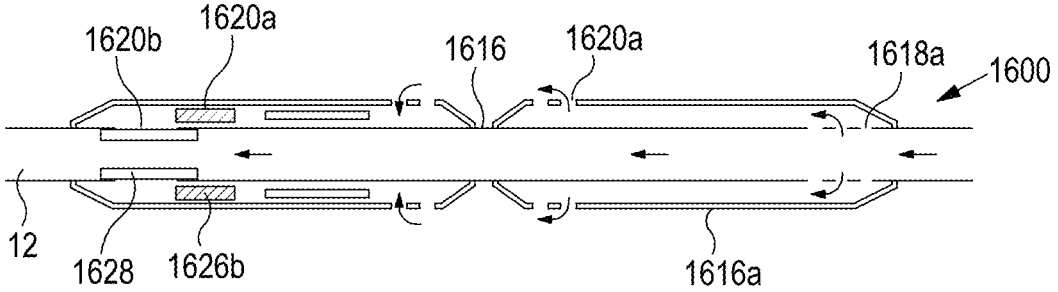

FIG. 18A to 18C are enlarged sections of a shunt chamber apparatus 1600 according to an embodiment of the invention. The shunt chamber apparatus is installed on a production tubing 12. The shunt chamber apparatus 1616 has an outward venting section 1616*a* with an inlet 1618*a* in fluid communication with the production tubing and an outlet 1620*a* in fluid communication with annulus 11. The outward venting section 1616*a* has an annulus chamber 1621*a* surrounding the production tubing with a fluid volume 1622*a* between inlet 1618*a* and outlet 1620*a*.

The shunt chamber apparatus 1600 has an inward venting section 1616*b* with an inlet 1618*b* in fluid communication with the annulus 11 and an outlet 1620*b* in fluid communication with a production pipe 12. Arrows denote the direction of fluid travel. The inward venting section 1616*b* has a phase separation section 1625 and delay chamber 1621*b* surrounding the production tubing with a fluid volume 1622*b*. The delay chamber comprises a tracer material 1624*a* and 1624*b*. The shunt chamber also comprises flow restrictors 1626*a* and 1626*b*. The tracer material may be disposed in the delay chamber to allow fluid to contact the tracer material and pass around the tracer material in the fluid volume 1622*b*. The tracer materials 1624*a* and 1624*b* are designed to release tracer molecules or particles when exposed to a target well fluid i.e. oil, gas or water.

A valve assembly 1628 is fixed with a movably closure member for selectively opening and closing the outlet aperture 1620*b* to control the flow of fluid from the delay chamber 1621*b* to the production pipe.

In this example the valve assembly 1628 is a differential pressure operated valve designed to open and close in response to changes in differential pressure between the production tubing and the shunt chamber apparatus. In this case the change in differential pressure is controlled by adjusting the production flow rate. The valve assembly is set to open above a pre-set production flow rate threshold and close below the set threshold.

During normal production as shown in FIG. 18A the production flow rate is below the pre-set flow rate threshold and therefore the valve assembly remains closed. Fluid passes from the production pipe through inlet 1618*a* into the fluid volume 1622*a* of the annulus chamber 1621*a* and through outlet 1620*a* of the outward venting section 1616*a* into the annulus 11. Fluid enters the fluid volume 1622*b* of the inward venting section 1616*b* from the annulus 11 via inlet 1618*b*.

In the phase separation section 1625 high density and low density phases separate. The heavy phase will move to the lower portion of the chamber and the fluid of lower density will lie on top.

In fluid volume 1622*b* the tracer material is exposed to the target fluid and tracer molecules are released into the fluid. Tracer material 1624 in the fluid volume remains exposed to a volume of fluid in the fluid volume 1622 over the period of time that the valve 1626 is closed, building up a high concentration of the tracer particles in the inner fluid volume of the shunt chamber apparatus.

When a tracer release operation is required, the choke assembly is temporarily adjusted to increase the production flow rate to a second flow velocity which it higher than the pre-set threshold for the valve 1626, the valve 1626 opens the outlet 1620*b* releasing the fluid and high concentration tracer cloud into the production tubing 12. The high density phase flows through lower flow restrictor 1626*b* and low density phase flows through upper flow restrictor 1626*a* through the shunt chamber The tracer enriched fluid is gradually flushed out of the shunt chamber through flow restrictors 1626*a*, 1626*b* into the production tubing. The tracer cloud creates a high amplitude spike signal at a detection point followed by a decay curve of tracer signal which represents the gradually displacement and flush out of the tracer from the shunt chamber apparatus.

Figure 19A:
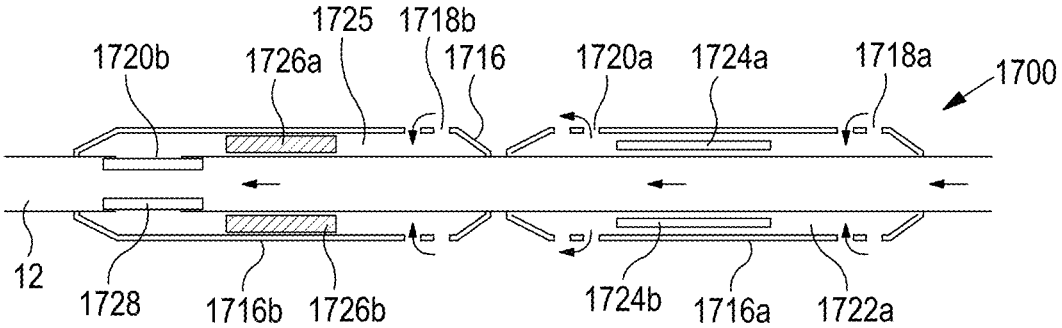
FIGS. 19A and 19C are schematic diagrams of shunt chamber comprising an outward venting section and inlet in communication with the annulus in accordance with an aspect of the invention.
Figure 19B:
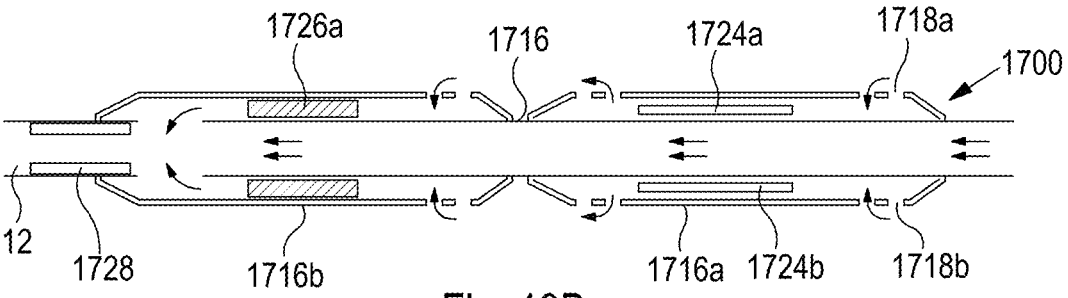
Figure 19C:
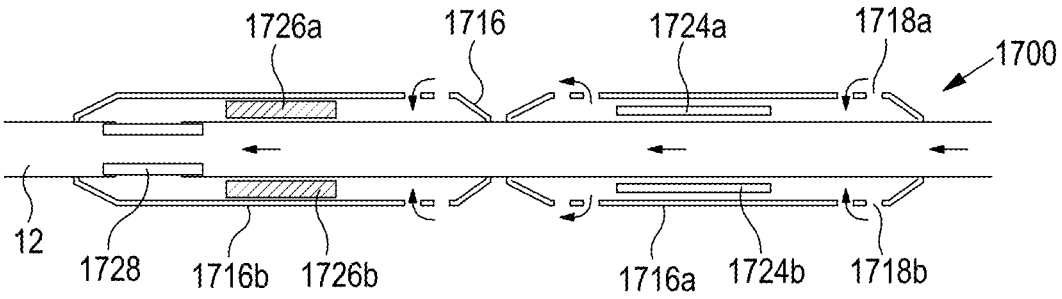

FIG. 19A to 19C are enlarged sections of a shunt chamber apparatus 1700. The shunt chamber apparatus is installed on a production tubing 12. The shunt chamber 1716 has an outward venting section 1716*a* with inlets 1718*a* and outlets 1720*a* in fluid communication with annulus 11. The outward venting section 1716*a* has an annulus delay chamber 1721*a* surrounding the production tubing with a fluid volume 1722*a* which comprises a tracer materials 1724*a* and 1724*b*. The tracer materials are disposed in the tracer chamber to allow fluid to contact the tracer material and pass around the tracer material in the fluid volume 1722*a*. The tracer materials 1724*a* and 1724*b* are designed to release tracer molecules when exposed to a target well fluid i.e. oil, gas or water.

The shunt chamber apparatus 1700 has an inward venting section 1716*b* with inlets 1718*b* in fluid communication with the annulus 11 and an outlets 1720*b* in fluid communication with a production pipe 12. Arrows denote the direction of fluid travel. The inward venting section 1716*b* has an annulus chamber 1721*b* surrounding the production tubing with a fluid volume 1722*b* between inlet 1718*b* and outlet 1720*b*. The inward venting section 1716*b* has a phase separation section 1725 and flow restrictors 1726*a* and 1726*b*.

A valve assembly 1728 is fixed with a movably closure member for selectively opening and closing the outlet apertures 1720*b* to control the flow of fluid from the annulus chamber 1721*b* to the production pipe.

In this example the valve assembly 1728 is a differential pressure operated valve designed to open and close in response to changes in differential pressure between the production tubing and the shunt chamber apparatus. In this case the change in differential pressure is controlled by adjusting the production flow rate. The valve assembly is set to open above a pre-set production flow rate threshold and close below the set threshold.

During normal production as shown in FIG. 19A the production flow rate is below the pre-set flow rate threshold and therefore the valve assembly remains closed. Fluid passes from the annulus through inlet 1718*a* into the fluid volume 1722*a* of the annulus tracer chamber 1721*a* and through outlet 1720*a* of the outward venting section 1716*a* into the annulus 11. In the fluid volume 1722*a* the tracer materials are exposed to their respective target fluids and tracer molecules are released into the fluid.

Fluid enters the fluid volume 1722*b* of the inward venting section 1716*b* from the annulus 11 via inlet 1718*b*. The fluid with tracer molecules is prevented from entering the production tubing while the valve 1726 is closed. In the phase separation section 1725 high density and low density phases separate. The heavy phase will move to the lower portion of the chamber and the fluid of lower density will lie on top.

When a tracer release operation is required, the choke assembly is temporarily adjusted to increase the production flow rate to a second flow velocity which it higher than the pre-set threshold for the valve 1726, the valve 1726 opens the outlet 1720*b* releasing the fluid and tracer molecules into the production tubing 12. The high density phase flows through lower flow restrictor 1626*b* and low density phase flows through upper flow restrictor 1726*a* through the shunt chamber.

The tracer enriched fluid is gradually flushed out of the shunt chamber through flow restrictors 1726*a*, 1726*b* into the production tubing. The released tracer creates a high amplitude spike signal at a detection point followed by a decay curve of tracer signal which represents the gradually displacement and flush out of the tracer from the shunt chamber apparatus.

In the above example tracer materials are disposed in the annulus chamber 1721*a* of either the outward venting section 1716*a* or the inward venting section 1716*b*. However, it will be appreciated that tracer material may be alternatively or additionally may be disposed both the inward and outward venting sections. In the examples where tracer material is disposed in the outward venting section 1716*a* and inward venting sections the tracer material in the inward venting section may be same or different to the tracer material in the outward venting section.

In the above examples described in FIGS. 18A to 19C the shunt chamber apparatus is configured to shut in the shunt chamber apparatus during normal low production and release the high concentration of tracer by temporarily increasing the production flow rate. However it will be appreciated that the shunt chamber apparatus may alternatively be configured to shut in during normal high production in high production wells and release the tracer by temporarily decreasing the production flow rate.

It above examples described in FIGS. 18A to 19C the flow restrictors are located downstream of the tracer materials. However, it will be appreciated the flow restrictors may located upstream of the tracer materials. It will also be appreciated that the flow phases may be separated before or after the fluid contacts the tracer material.

It will also be appreciated the shunt chamber apparatus may be configured to allow release of tracer during normal production flow and to be temporarily shut in by adjusting the flow production flow rate.

It will be further appreciated that although the above examples described in FIGS. 18A to 19C have a valve disposed at the outlet 1720*b* of the tracer release operation, it will be understood from the above examples that valves may be positioned at any and/or all of the inlets and/or outlets of the shunt chamber apparatus. For examples valve assemblies may control the flow of fluid through outlets 1720*a* and/or 1720*b*. Alternatively or additionally valve assemblies may control the flow of fluid through inlets 1718*a* and/or 1718*b*.

The data collected at the detection point as described in the above examples may be analysed to identify the arrival of the concentration peaks of each tracer to determine the percent of inflow that occurs between tracer locations. The tracer locations may be known locations in the well geometry.

When the distinct tracer is released from two or more shunt chamber apparatus to the surface their arrival at the surface is monitored and analysed to determine the inflow distribution. The volume between the arrival of each tracer peak is proportional to the inflow that occurs upstream of each tracer. The tracer transients are driven by the velocity field in the well. The topside arrivals of the tracers can be used to estimate the downhole velocity field. From the velocity field the inflow profile may be calculated. The concentration of tracers at surface as a function of time is related to the influx into the well, by the velocity field. The tracer concentrations are governed by the velocity field. The velocity field is influenced by the well geometry and transport path of the fluid flow.

A model may be used based on the well geometry of the production well that assumes a specific scenario of inflow distribution, simulates the arrival time of the tracer peaks, and compares the simulated results to the actual peak arrivals. After several iterations, the model may converge on a solution that provides an inflow distribution that best fits the actual data.

The model may include a model transport path corresponding to the actual well's transport path downstream of the influx zones.

The model should include an influx model corresponding to the real influx locations, a tracer system model and having even model leak or release rate corresponding to the real tracer sources and a model well transport path corresponding to the actual production well.

The tracer concentration may be calculated as a function of time. The measured tracer concentrations may be compared with modelled tracer concentrations to derive information about downhole inflow profiles.

Samples may be collected and/or measured downstream at known sampling times. Based on the measured concentrations and their sampling sequence and the well geometry the influx volumes may be calculated. The influx volumes may be calculated from transient flow models.

Model concentrations for each tracer material may be calculated in a modelled downstream well flow transport path as a function of time under a modelled transient occurring in the model.

Additionally or alternatively the data collected at the detection point as described in the above examples may be analysed to identify the rate of decline of the tracer concentration from each tracer location to determine the percent of reservoir inflow from each influx zone. When the tracer is flushed out of the shunt chamber apparatus the zones with high inflow rates flush out the tracer faster than zones with low inflow rates, thereby preserving the high concentration of tracer molecules and generating a profile with steep rates of decline. Conversely the concentration of tracer molecules in the fluid that is flushed out from a low-performing zone becomes more diluted as it enters the main flow stream and travels to the surface. Consequently, the profile of the tracer concentration presents a less steep rate of decline when compared to a high-performing zone. The data may be analysed to compare the rate of decline in tracer concentration between each monitored zone and quantitatively determines the respective relative inflow rates.

The present invention provides apparatus and method for quantitative multi-phase downhole petroleum surveillance. The apparatus comprises a flow shunt chamber for a shunt flow. The flow shunt chamber comprises one or more inlets and one or more outlets arranged in an upstream portion and a downstream portion of the tracer shunt chamber respectively. The flow shunt chamber also comprises a flow phase separation section, a tracer delay chamber, a tracer releasing system for at least one tracer; and at least one flow restrictor in fluid communication with the delay chamber.

An advantage of the invention is that it allows the phases to separate inside the shunt chamber, be exposed to tracer and allows each phase to flow through a known restrictor, designed for each phase. This means that the behaviour of each phase inside the shunt chamber is known and the velocity will be proportional to the differential pressure from inlet to outlet of the shunt chamber inside the tube, base pipe, i.e. in the production flow.

The differential pressure is what drives the separated flows through the shunt chamber. The amount of each separated phase inside the chamber and the design of the restrictor will set the duration of the tracer trace at the monitoring point, seen as a concentration value. One may get a long-lasting tracer trace signal.

The present invention provides a shunt chamber apparatus capable of improved quantitative multi-phase downhole petroleum surveillance by measuring production rate of each phase in a two-phase flow.

Providing a shunt chamber which is capable of being shut in allows for the selective generation and release of high concentrations of tracer molecules without requiring the shutting in of the well.

A benefit of the present invention is that accurate flow analysis may be conducted in a multiphase system as it captures a moment of time in the production flow and enables the different phases to contact their respective phase specific tracers improving the certainty of multiphase analysis.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as", "downstream", "upstream", "upper", "lower" and the like are used herein to indicate directions and locations as they apply to the appended drawings and will not be construed as limiting the invention and features thereof to particular arrangements or orientations. Likewise, the term "outlet" shall be construed as being an opening which, dependent on the direction of the movement of a fluid and may also serve as an "inlet", and vice versa.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention as defined by the appended claims.

Various modifications to the above-described embodiments may be made within the scope of the invention, and the invention extends to combinations of features other than those expressly claimed herein.

The invention claimed is:

1. A method for quantitative downhole surveillance of a multi-phase flow in a hydrocarbon well, wherein the multiphase flow comprises at least two phases, the well comprising at least one shunt chamber; wherein the at least one shunt chamber comprises:

a flow phase separation section;

at least one delay chamber;

a tracer releasing system for at least one tracer; and at least one flow restrictor in fluid communication with the at least one delay chamber;

the method comprising:

separating flow in the shunt chamber into at least two phases;

releasing at least one tracer into the at least one delay chamber;

flushing out the flow with the at least one tracer from the shunt chamber into the production flow, monitoring the at least one tracer in a production flow at a detection point downstream of the at least one shunt chamber;

measuring the concentration of the at least one tracer in a monitored flow.

2. The method according to claim 1 comprising calculating a characteristic flush-out time of the at least one tracer from the at least one delay chamber, or travel time of the at least one tracer through the shunt chamber based on concentration of the at least one tracer in the monitored flow.

3. The method according to claim 1 comprising separating shunt flow into low density flow phase and high density flow phase in the flow phases separation section before releasing the tracer or exposing the flow to the at least one tracer.

4. The method according to claim 1 comprising releasing at least one tracer into the shunt flow or exposing the flow to the tracer before separating shunt flow into low density flow phase and high density flow phase in the flow phases separation section.

5. The method according to claim 1 comprising releasing the at least one tracer into the at least one delay chamber to form a tracer cloud, or several discrete clouds in the at least one delay chamber.

6. The method according to claim 5 comprising shutting in the at least one shunt chamber and forming the tracer cloud in the at least one shunt chamber.

7. The method according to claim 1 comprising shutting in the at least one shunt chamber by modifying a production flow rate in the well.

8. The method according to claim 1, wherein the at least one shunt chamber comprises at least one inlet ports and at least one outlet port.

9. The method according to claim 8 comprising flushing out low-density phase flow and high-density phase flow with the tracer cloud from the shunt chamber through the at least one outlet port into the local flow inside the well.

10. The method according to claim 8 comprising using the differential pressure between the at least one inlet port and the at least one outlet port to flush out the tracer cloud from the at least one shunt chamber.

11. The method according to claim 8 comprising using a predefined chamber volume and estimating pressure drop in the well between the at least one inlet port and the at least one outlet port.

12. The method according to claim 1 comprising calculating hold up and/or flow rates for each phase of local multiphase flows.

13. The method according to claim 1 comprising calculating production rates of each of the two phases based on a measured flush-out time of tracers from the at least one delay chamber.

14. The method according to claim 1 comprising monitoring by in-flow stream detection, probe detection, clamp on measurement or executed by physical sampling.

15. A shunt chamber tracer apparatus for quantitative multi-phase downhole petroleum surveillance wherein the apparatus comprises;

a flow phase separation section;

at least one delay chamber;

a tracer releasing system for at least one tracer; and at least one flow restrictor in fluid communication with the at least one delay chamber.

16. The shunt chamber tracer apparatus according to claim 15 wherein the at least one flow restrictor is phase specific.

17. The shunt chamber tracer apparatus according to claim 15 wherein the at least one flow restrictor has a predefined restriction efficiency.

18. The shunt chamber tracer apparatus according to claim 15 wherein the tracer releasing system is a tracer injection system or a tracer matrix carrier system.

19. An interpretation method for multi-phase downhole surveillance for a petroleum well with a production flow in a well comprising providing data from a producing well having at least one shunt chamber;

wherein the shunt chamber comprises:

a flow phase separation section;

at least one delay chamber;

a tracer releasing system for at least one tracer; and at least one flow restrictor;

wherein the data comprises measurements of tracers in the production flow at a detection point (D) downstream of the at least one shunt chamber to determine tracer concentration values for the at least one tracer; and calculating flow characteristic for the multi-phase flow based on the tracer concentration.

20. A method of collecting samples for analysis in monitoring a multi-phase flow well, the well comprising;

at least one shunt chamber comprising;

a flow phase separation section;

at least one delay chamber;

a tracer releasing system for at least one tracer; and at least one flow restrictor;

separating flow in the shunt chamber into at least two phases;

releasing at least one tracer into the at least one delay chamber;

flushing out the flow with tracer from the shunt chamber into the production flow; and collecting samples at a location downstream of the at least one shunt chamber.

* * * * *